US011679918B2

(12) United States Patent
Falzoni et al.

(10) Patent No.: US 11,679,918 B2
(45) Date of Patent: Jun. 20, 2023

(54) CAP FOR CLOSING A CONTAINER AND ITS METHOD FOR MAKING THE CAP

(71) Applicant: SACMI COOPERATIVA MECCANICI IMOLA SOCIETA' COOPERATIVA, Imola (IT)

(72) Inventors: Alessandro Falzoni, Imola (IT); Vitttorio Bassi, Faenza (IT)

(73) Assignee: SACMI COOPERATIVA MECCANICI IMOLA SOCIETEA' COOPERATIVA, Imola (IT)

( * ) Notice: Subject to any disclaimer, the term of this patent is extended or adjusted under 35 U.S.C. 154(b) by 0 days.

(21) Appl. No.: 17/595,981

(22) PCT Filed: Feb. 23, 2021

(86) PCT No.: PCT/IB2021/051494

§ 371 (c)(1),
(2) Date: Dec. 1, 2021

(87) PCT Pub. No.: WO2021/171168

PCT Pub. Date: Sep. 2, 2021

(65) Prior Publication Data

US 2022/0355988 A1 Nov. 10, 2022

(30) Foreign Application Priority Data

Feb. 24, 2020 (IT) ..... 102020000003781

(51) Int. Cl.
*B65D 55/16* (2006.01)
*B65D 41/34* (2006.01)

(52) U.S. Cl.
CPC ..... *B65D 55/16* (2013.01); *B65D 41/3428* (2013.01); *B65D 2251/1008* (2013.01); *B65D 2401/30* (2020.05)

(58) Field of Classification Search
CPC ..... B65D 55/16; B65D 41/3428; B65D 2251/1008; B65D 2401/30
See application file for complete search history.

(56) References Cited

U.S. PATENT DOCUMENTS 6,474,491 B1 5/2002 Benoit-Gonin et al.
10,654,625 B2 * 5/2020 Migas ..... B65D 1/0246
(Continued)

FOREIGN PATENT DOCUMENTS

FR 2785264 A1 5/2000
JP 2014031202 A 2/2014
(Continued)

*Primary Examiner* — James N Smalley
(74) *Attorney, Agent, or Firm* — Pearne & Gordon LLP; J. Gregory Chrisman

(57) ABSTRACT

A cap for a container is provided and a related method for making the cap. The cap comprises a side wall extending about an axis and a transversal wall arranged at an end of the side wall, a separation line being provided on the side wall for defining: a retaining ring, which is intended to remain anchored to a neck of the container and is configured to internally engage with an enlargement of the neck; and a closure element which can removably engage the neck, so as to open or close the container. The separation line extends about the axis and is circumferentially interrupted so as to leave a joining portion, between the retaining ring and the closure element, which extends circumferentially for a respective angle, the cap further having an incision line which extends transversally to the axis between the separation line and a free edge of the retaining ring, so that two connecting bands are defined between the separation line and the incision line, the two connecting bands joining the retaining ring to the joining portion. The connecting bands are deformable and the joining portion is externally provided with a projection which projects from the joining portion and is positioned between a separation plane in which the (Continued)

separation line lies and the incision line so that, when the closure element is in the open position and the connecting bands keep the closure element connected to the retaining ring, an edge of the joining portion which, in the closed position, faces the retaining ring, is facing, in the open position, towards a rim of the neck and the projection is resting on the neck in said open position.

16 Claims, 18 Drawing Sheets

(56) References Cited

U.S. PATENT DOCUMENTS

| | | | | |
|---|---|---|---|---|
| 2011/0297682 | A1 | 8/2011 | Kwon | |
| 2012/0024815 | A1 | 2/2012 | Kwon | |
| 2020/0369446 | A1* | 11/2020 | Mélan-Moutet ... | B65D 41/3447 |

FOREIGN PATENT DOCUMENTS

| | | | |
|---|---|---|---|
| WO | 2009/002057 | A2 | 12/2008 |
| WO | 2009/048273 | A2 | 4/2009 |

* cited by examiner

Fig.16
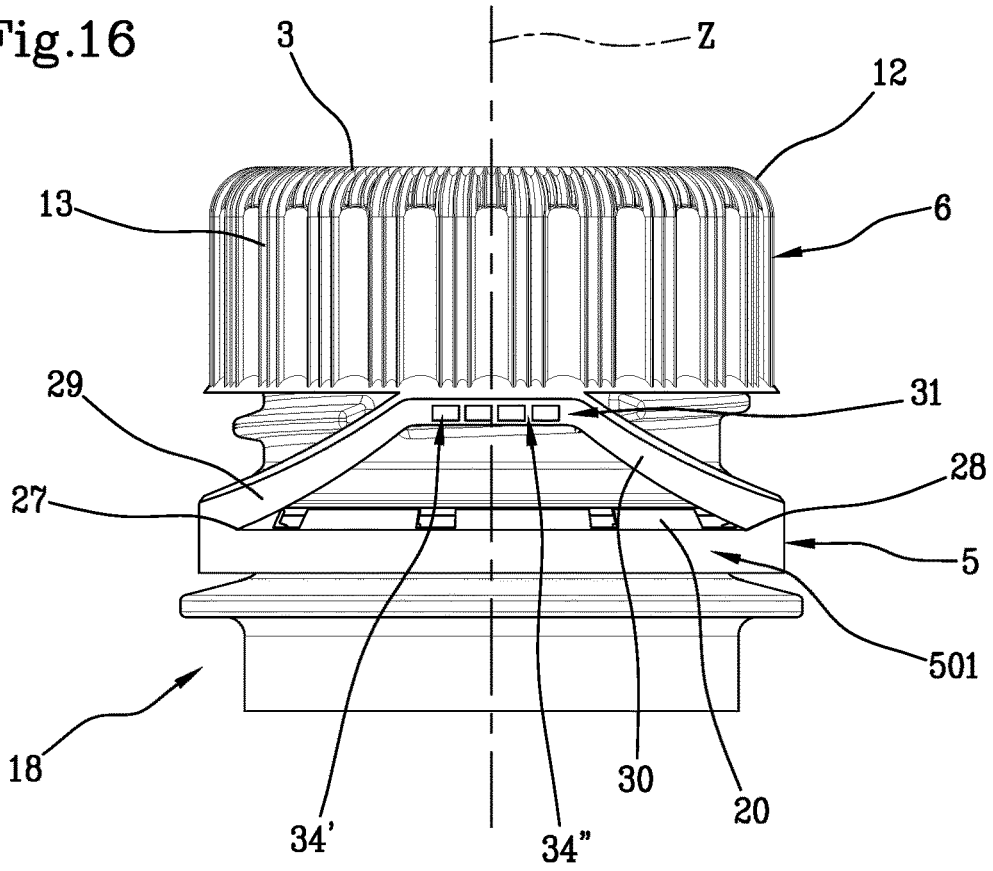
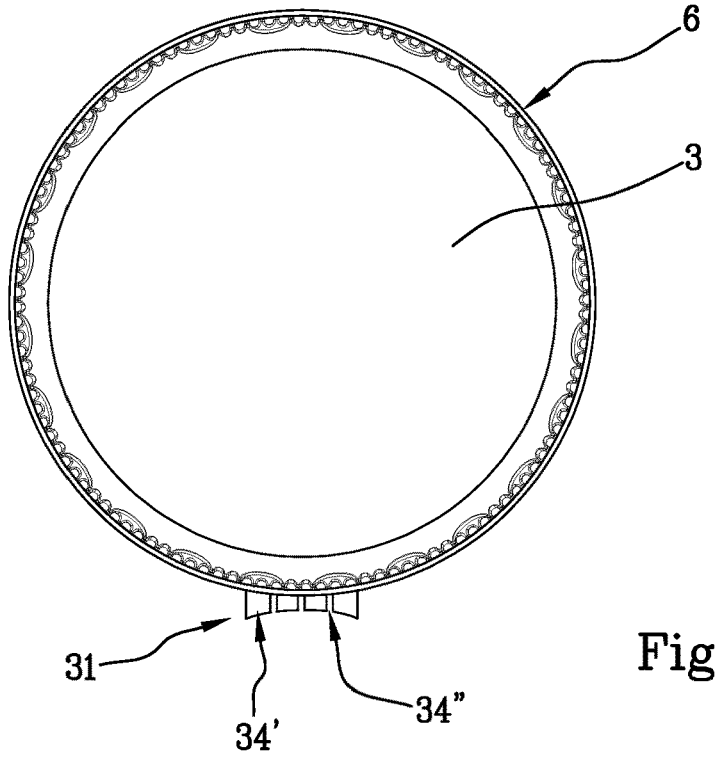
Fig.15

Fig.19
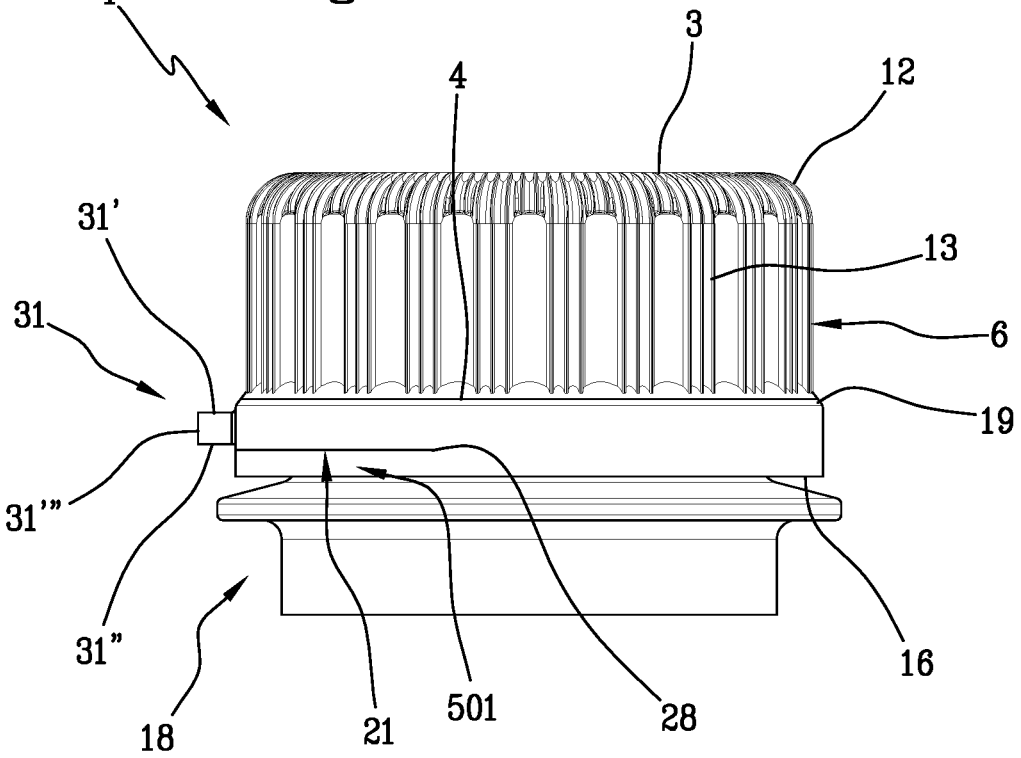
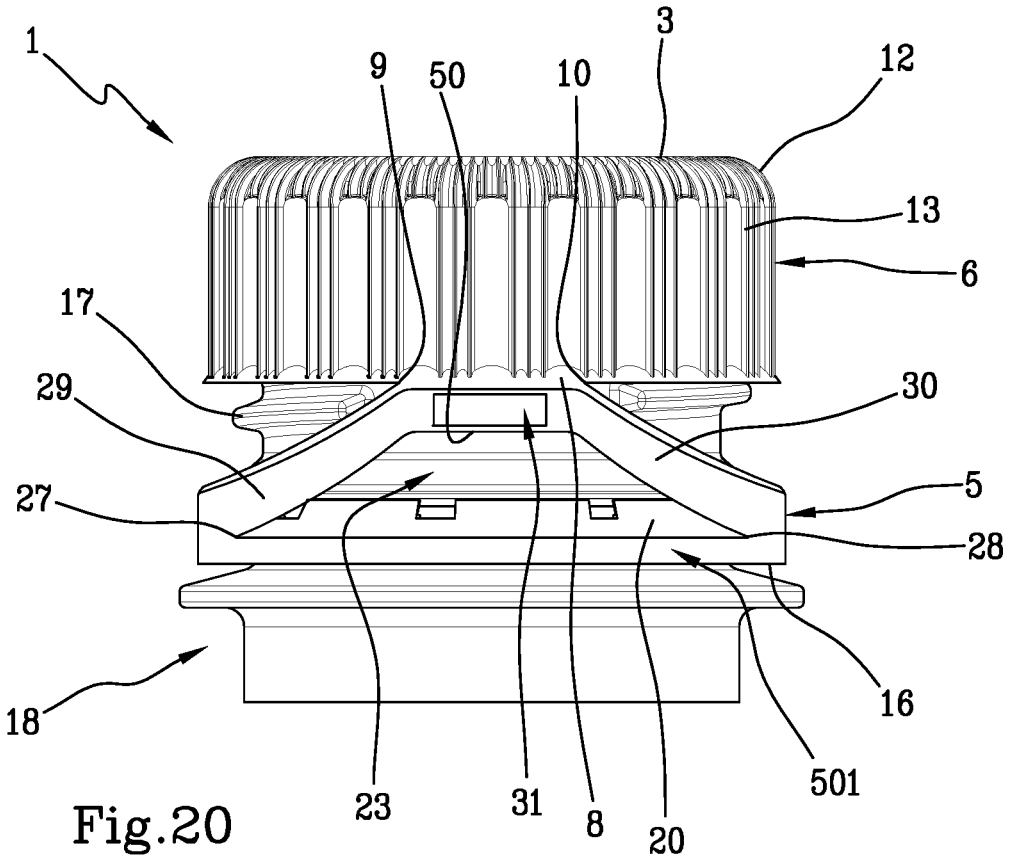
Fig.20

Fig.22
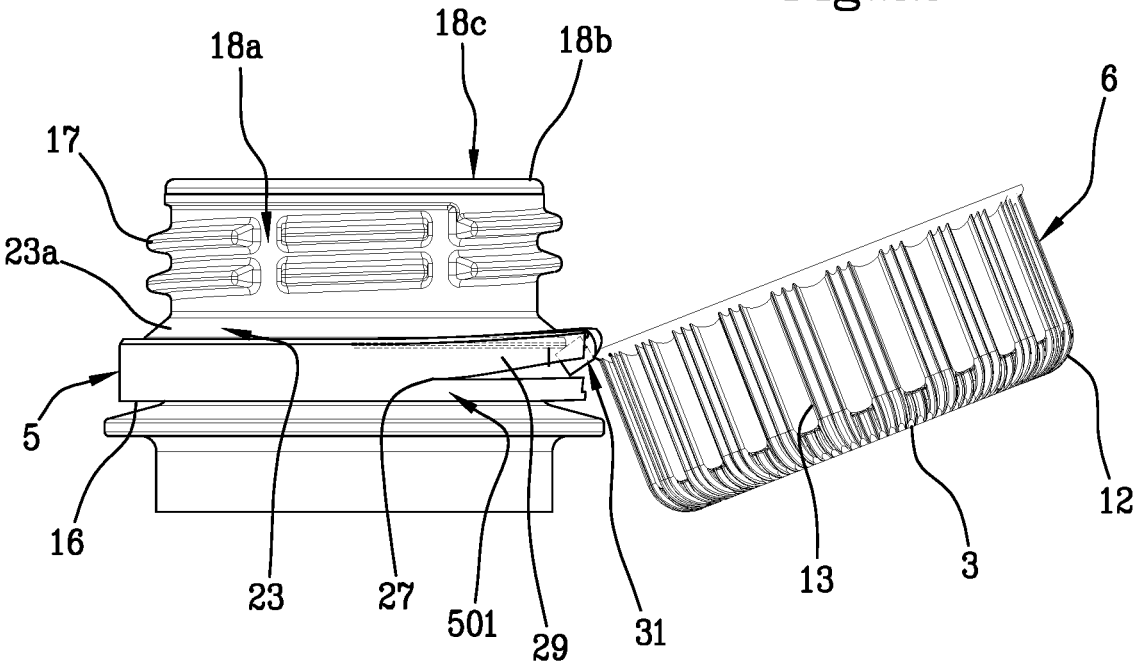
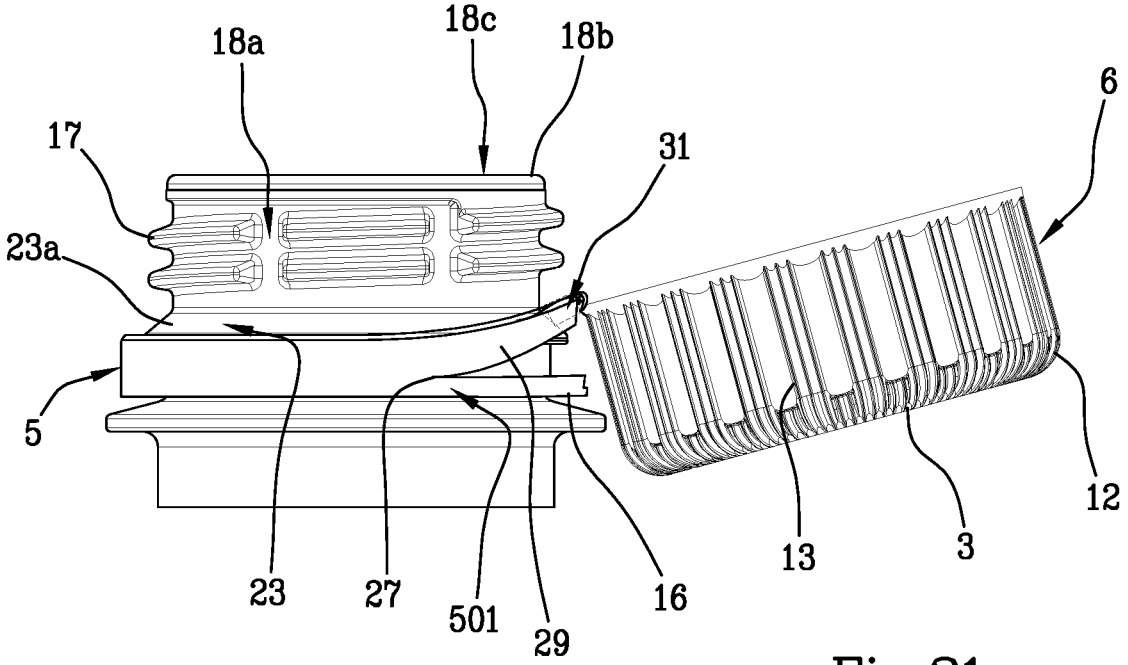
Fig.21

Fig.24
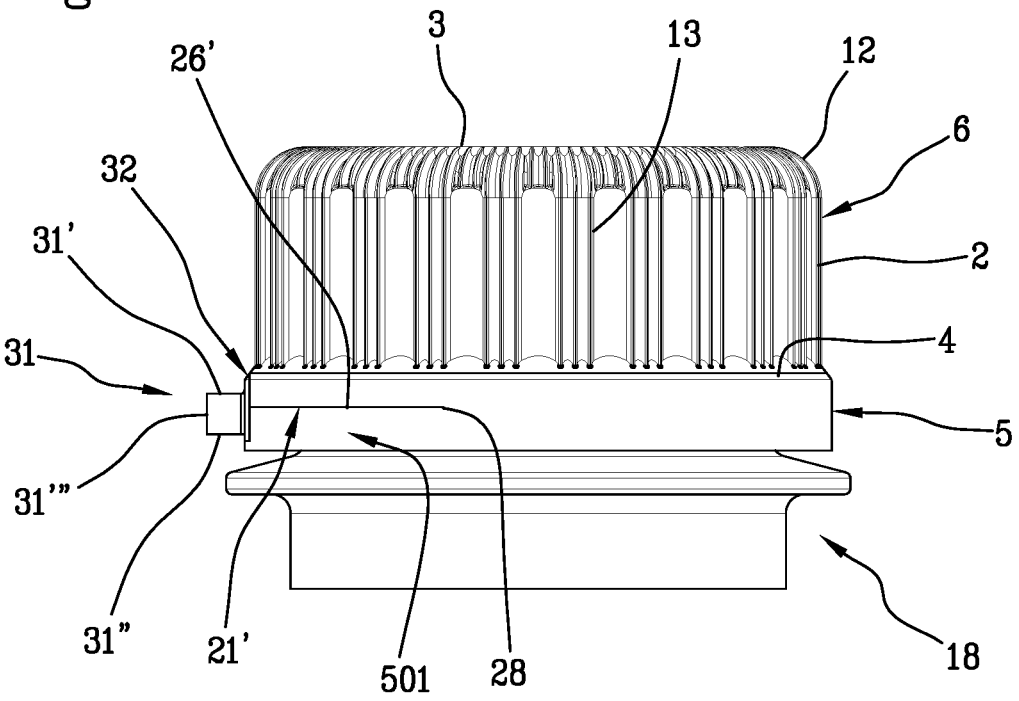
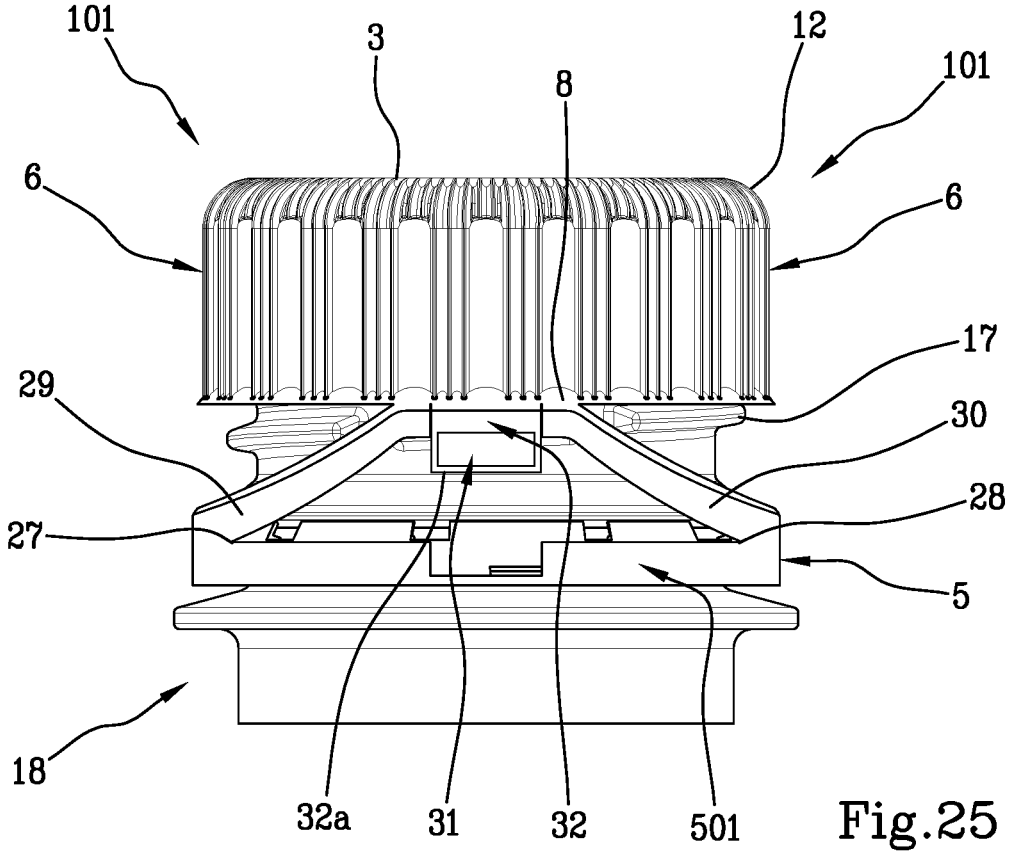
Fig.25

Fig.26
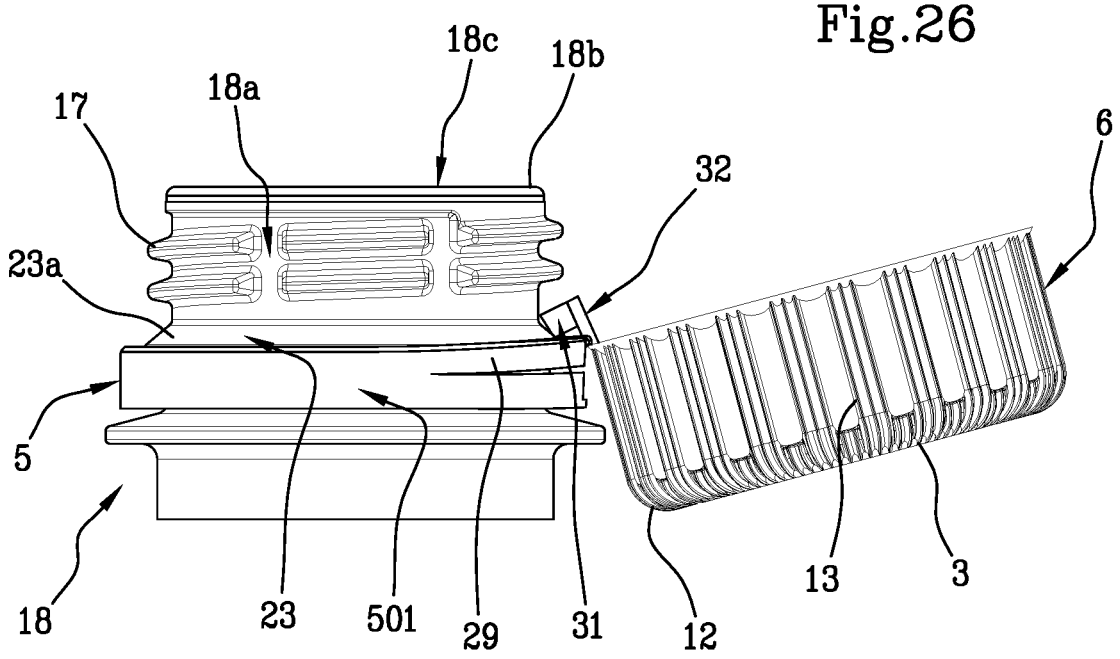
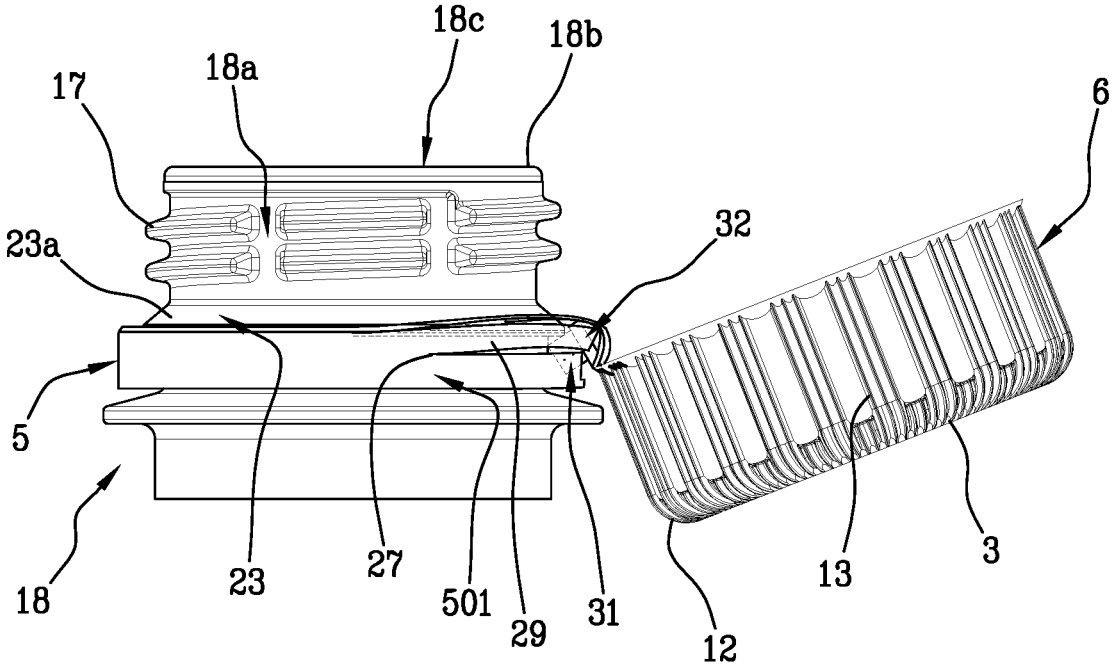
Fig.27

CAP FOR CLOSING A CONTAINER AND ITS METHOD FOR MAKING THE CAP

The invention relates to a cap for a container, in particular a cap provided with a retaining ring, which can be associated with a neck of the container, the cap further being provided with a closure element which, after opening, remains connected to the retaining ring. The cap according to the invention is particularly, but not exclusively, suitable for being applied to bottles intended to contain liquid substances.

The invention also relates to a related method for making that cap.

Caps for bottles are known, which comprise a cup-shaped body provided with an inner thread suitable for engaging with an outer thread of a neck of the bottle. The known caps are further provided with a tamper-evident ring connected to the cup-shaped body by means of a plurality of breakable elements. When the cap is opened for the first time, the cup-shaped body separates from the tamper-evident ring due to breakage of the breakable elements. The tamper-evident ring remains associated with the neck of the bottle, whilst the cup-shaped body can be unscrewed by the user, who in this way separates the cup-shaped body from the bottle to access the contents of the bottle. Subsequently, the cup-shaped body can be screwed on the neck again to reclose the bottle.

Sometimes, after the bottle has been emptied, the user throws the cup-shaped body on the ground, either intentionally or accidentally, whilst the bottle, together with tamper-evident ring associated with it, is correctly thrown in a waste bin.

To overcome this drawback, caps have been proposed which are provided with a retaining ring, which can be associated with a neck of a bottle, and a closure element, connected to the retaining ring by means of a hinge. The closure element can be rotated about the hinge between an open position, in which a user can access the contents of the bottle, and a closed position, in which the closure element prevents access to the bottle. The hinge keeps the closure element associated with the retaining ring and, therefore, with the bottle, thereby preventing the closure element from being thrown on the ground independently of the bottle.

However the known caps provided with a hinge have the drawback of being rather complicated to manufacture. Indeed, the hinge is usually produced in the same mould in which the cap is obtained, in particular by injection moulding or compression moulding.

In order to produce the caps with a hinge of known type it is therefore necessary to provide special moulds, different from those which are normally adopted for producing the caps free of the hinge. Such moulds are more complex than ordinary moulds, in particular because the caps with a hinge of known type can be provided with zones with a very reduced thickness, which are difficult to obtain because the molten polymeric material flows with difficulty in the portions of the mould intended to form these zones.

This increases the costs for the production of the caps with hinge and/or the cycle time necessary to obtain them.

In caps with a hinge of the known type, the closure element, after having been moved to the open position, sometimes prematurely recloses by rotating about the hinge. It may also be the case that the closure element partially rotates about the hinge, moving into a vertical, or almost vertical configuration. In these cases, the closure element may in an unwelcome way strike the face of a user, who is drinking from the bottle to which the cap with hinge is applied, or be interposed in the desired way between the bottle and a container, for example a glass, into which a liquid contained in the bottle is poured.

Moreover, in caps with a hinge of the known type, when the closure element has been moved to the open position, the retaining ring, which remained associated with the neck, is free to rotate about the neck itself. Therefore, it may be the case that, whilst a user is drinking a liquid contained in the bottle to which the cap with a hinge is applied, or is pouring the liquid contained in the bottle into a glass, the retaining ring rotates about the neck due to the force of gravity, together with the closure element. If that occurs, the closure element may strike the face of the user who is drinking, or be interposed between the neck of the bottle and the glass, which obstructs the dispensing of the liquid into the glass.

Document WO2009048273 shows a cap capable of remaining coupled to a neck of a container even after the cap has been opened for the first time, which comprises a protuberance positioned above a portion of hinge, which is configured to pass above the retaining ring of the cap and to be fixed by interlocking to a supporting step present in the neck, after the cap has been opened.

One aim of the invention is to improve the caps of known type, particularly the caps comprising a retaining ring intended to remain associated with a neck of the container and a closure element which can removably engage with the neck to allow a user to open or alternatively close the container.

Another aim is to provide a cap for a container, of the type mentioned above, which can easily be produced.

A further aim is to provide a cap for a container, comprising a closure element which remains connected to the retaining ring, wherein the closure element is kept stable when the cap is in an open position.

Another aim is to provide a cap for a container wherein, in the open position, there is reduced risk of the closure element accidentally striking the face of the user or obstructing the dispensing of a substance contained in the container into a glass or the like.

According to the invention, what is provided is a cap for a container according to claim 1 and the claims dependent on it and a method for making the cap according to claim 19.

In one aspect of the invention, a cap for a container is provided, comprising a side wall extending about an axis and a transversal wall arranged at an end of the side wall, a separation line being provided on the side wall for defining a retaining ring intended to remain anchored to a neck of the container, which is configured to internally engage with enlargement of the neck; and a closure element which can removably engage the neck, so as to open or close the container; wherein the separation line extends about the axis and is circumferentially interrupted so as to leave a joining portion between the retaining ring and the closure element which extends circumferentially for a respective angle, the cap also having an incision line which extends transversally to the axis between the separation line and a free edge of the retaining ring, so that two connecting bands are defined between the separation line and the incision line, the two connecting bands joining the retaining ring to the joining portion; wherein the connecting bands are deformable, for allowing the joining portion to rotate when the closure element is moved from a closed position to an open position, and wherein the joining portion is externally provided with a projection which projects from the joining portion and is positioned between a separation plane in which the separation line lies and the incision line so that, when the closure element is in the open position and the connecting bands keep the closure element connected to the retaining ring, an edge of the joining portion which, in the closed position, faces the retaining ring, is facing, in the open position, towards a rim of the neck and the projection is resting on the neck, in said open position.

Thanks to the joining portion, the closure element can be stably associated with the retaining ring and therefore with the neck of the container. This prevents the closure element from being thrown on the ground separately from the container. This thus increases the probability that the closure element, together with the container, is correctly disposed of together with waste of the same type, in particular together with plastic material waste.

Thanks to the invention, that is to say, thanks to the projection with which the joining portion is provided, it is possible to obtain a cap capable of stably remaining in the open position. Indeed, when the joining portion rotates while the closure element passes from the closed position to the open position, interference occurs between the projection and the neck of the container, since the projection rests on it. This interference persists even in the open position. In order to return the closure element to the closed position, a predetermined force must be applied to the closure element, so as to overcome the interference between the neck and the projection. This makes it difficult, if not impossible, for the closure element to return to the closed position on its own.

In more detail, in the open position, when the projection rests on the neck of container, the connecting bands, which have been deformed, also apply on the joining portion a force which tends to keep the joining portion in contact with the neck of the container and they operate in conjunction with the projection. That causes the interference between the projection and the neck of the container, which stably keeps the closure element in the open position.

Moreover, thanks to the fact that the projection is positioned between the separation line and the incision line, it is possible to make the projection stably rest near the enlargement of the neck. This is positive because a user can notice if a maximum interference with the enlargement is overcome when the projection must be disengaged from the enlargement.

If the projection is positioned nearer the incision line than the separation line, an end edge of the projection can be positioned resting on the neck in the open position, for example above the enlargement, or on an upper wall of the enlargement, facing towards a rim of the neck.

In this case the user, in order to disengage the closure element locked by the projection and by the twisting of the connecting bands, will have to pull the closure element outwards, making the projection slide on the upper wall of the enlargement.

If, in contrast, the projection is positioned nearer the separation line than the incision line, a lower wall of the projection which in the closed position is facing towards the free edge, can be positioned below the enlargement, for example to make contact with a lower wall of the enlargement facing the opposite way to the rim of the neck.

In this case the user, in order to disengage the closure element locked by the projection and by the twisting of the connecting bands, will have to pull the closure element outwards until the projection has completely disengaged from the enlargement.

Therefore, due to the fact that the projection is positioned between the separation line and the incision line, the user is forced to disengage the projection from the enlargement in order to move the closure element away from the neck. This is advantageous because he or she can notice when the maximum interference is overcome and, therefore, when the closure element can be moved away from the neck.

Thanks to the interference between the projection and the neck, there is also obstruction of rotation of the cap, in particular of the retaining ring, about the neck.

In one embodiment, the connecting bands are deformable by a twisting movement when the closure element is moved from the closed position to the open position.

This twisting movement may affect at least one part of the axial dimension of each connecting band, defined as the dimension of the connecting band along a line parallel to the axis, in the closed position of the closure element. While the joining portion rotates, its edge, initially facing towards the free edge, slides in contact with the neck until it reaches the open position in which that edge is facing towards the rim of the neck, the projection begins to position itself resting on the neck and generates an interference which reaches a maximum value when the joining portion is substantially perpendicular to the neck and the projection is in the final resting position, and which is reduced (but without reaching a null value) after the joining portion has overturned.

Again, even when passing to the open position, it is advantageous for the user to be able to notice when the maximum interference is overcome, since he or she can perceive when the projection is stably engaged on the enlargement.

The user who moves the closure element towards the open position notices that the position in which the interference is at its maximum has been passed, since their hand perceives that the closure element has been stably moved to the open position. That is welcomed by the user, who has the certainty of having correctly opened the container.

In one embodiment, the retaining ring comprises a retaining portion, which is configured to internally engage with the circular enlargement of the neck and extends between the incision line and the free edge of the retaining ring.

In one embodiment, the joining portion has an angular dimension about the axis of the side wall, greater than, or equal to, 20°, preferably greater than, or equal to, 25° and less than, or equal to, 120°, preferably less than, or equal to, 90°.

In this way, the joining portion can easily overturn but at the same time can stably keep the closure element in the open position.

In one embodiment, the joining portion comprises a tab which projects towards the free edge and is made by means of a central stretch and a pair of peripheral stretches of the incision line so that a bottom edge of the tab, defined by the central stretch, is facing towards a rim del neck, in the open position. The tab can optionally bend about a hinge line so that it can rest on the neck near the enlargement.

Advantageously, the projection can be at least partially positioned on the tab.

Thanks to this, the stability of the open position of the closure element relative to the neck is further strengthened since the tab, which protrudes relative to the connecting bands, allows the projection to be placed in various positions, even nearer the free edge of the cap, considering an axial line parallel to the axis of the side wall.

Moreover, thanks to the fact that the tab can optionally bend about the hinge line, the projection can better adapt to the shape of the neck of the container and therefore guarantee stable locking of the closure element on the neck, preventing the closure element from being able to perform any rotating movement, whether towards the supply opening or around the neck of the bottle.

In another aspect of the invention, a method for making a cap for a container is provided. Indeed, the cap according to the invention can be produced in a relatively simple manner, without need to use special moulds. Indeed, the cap according to the invention can be produced in a traditional mould, if the incision line is made by means of a cutting operation. It is possible by means of the cutting operation to obtain an incision line passing through the entire thickness of the side wall, or an incision line which does not pass through, at which the thickness of the side wall is cut only partially. It is also possible to consider the production of the incision line by moulding, inside the mould in which the cap is produced, but without, however, causing excessive complications of the mould, owing to the particularly simple shape of the incision line, even if the latter comprises a central stretch and a pair of peripheral stretches, optionally axially offset from each other, to obtain a tab. In this case, the incision line can even be shaped like a weakening line.

The projection can easily be made using the traditional mould, leaving in it a recessed zone, intended to make the projection which projects from the side wall of the cap.

Thanks to the fact that the incision line lies between the separation line and the free edge of the retaining ring, the incision line does not weaken the joining portion. In the cap according to the invention, the joining portion is therefore quite sturdy, which makes it more difficult to accidentally separate the retaining ring from the closure element.

The connecting bands, together with the joining portion, define a hinge arrangement which has a capacity for movement, along an axial line, noticeably greater than the capacity for movement which would be allowed by the joining portion alone.

Indeed, that hinge arrangement makes it possible to move the closure element away from the tamper-evident ring along a significant axial distance, determined by the combination of the length of the connecting bands and of the joining portion. In this way the closure element can be easily disengaged from the neck of the container.

The connecting bands can be positioned symmetrically to each other relative to a plane containing the axis of the side wall and a centre line of the joining portion to obtain a symmetrical shape which allows a reduction in the involuntary movements of the closure element when the cap is in an open position, in particular limiting its lateral movements.

In one embodiment, the joining portion has a substantially constant thickness in the separation plane containing the separation line.

That makes the cap according to the invention even easier to make, since special moulds are not necessary for producing triangular hinges or very thin joining portions.

The invention can be better understood and implemented with reference to the accompanying drawings, which illustrate several non-limiting example embodiments of it, in which:

FIG. 15 is a top view of another variant of the cap of FIG. 1, wherein the projection has a concave shape and is interrupted;

FIG. 16 is a front view of the cap of FIG. 15, in the spaced apart configuration wherein the closure element of the cap is separated from the retaining ring;

FIG. 19 is a side view of a cap according to a further alternative embodiment of that of FIG. 1, wherein the projection of the cap has a thickness greater than the projection of the cap of FIG. 1;

FIG. 20 is a front view of the cap of FIG. 19, in the spaced apart configuration wherein the closure element of the cap is separated from the retaining ring;

FIG. 21 is a side view of the cap of FIG. 19, in the open position wherein the projection is resting on the upper wall of the enlargement of the neck;

FIG. 22 is a side view of an embodiment of the cap of FIG. 19, in the open position, wherein the projection makes contact with the lower wall of the enlargement of the neck;

FIG. 24 is a side view of a cap according to a further other alternative embodiment of that of FIG. 9, in the closed configuration, wherein the projection of the cap is positioned on the tab and the projection of the cap has a thickness greater than the projection of the cap of FIG. 9;

FIG. 25 is a front view of the cap of FIG. 24, in the spaced apart configuration wherein the closure element of the cap is separated from the retaining ring;

FIG. 26 is a side view of the cap of FIG. 24, in the open position wherein the projection is resting on the upper wall of the enlargement of the neck;

FIG. 27 is a side view of an embodiment of the cap of FIG. 24, in the open position, wherein the projection makes contact with the lower wall of the enlargement of the neck;

Hereinafter, the same numbers will be used to refer to the same elements in the various figures. It should also be noticed that, unless differences are explicitly indicated, it shall be understood that the same elements can also be applied to the different variants.

With reference to the accompanying figures, the number 1 denotes a cap according to this invention.

Figure 1:
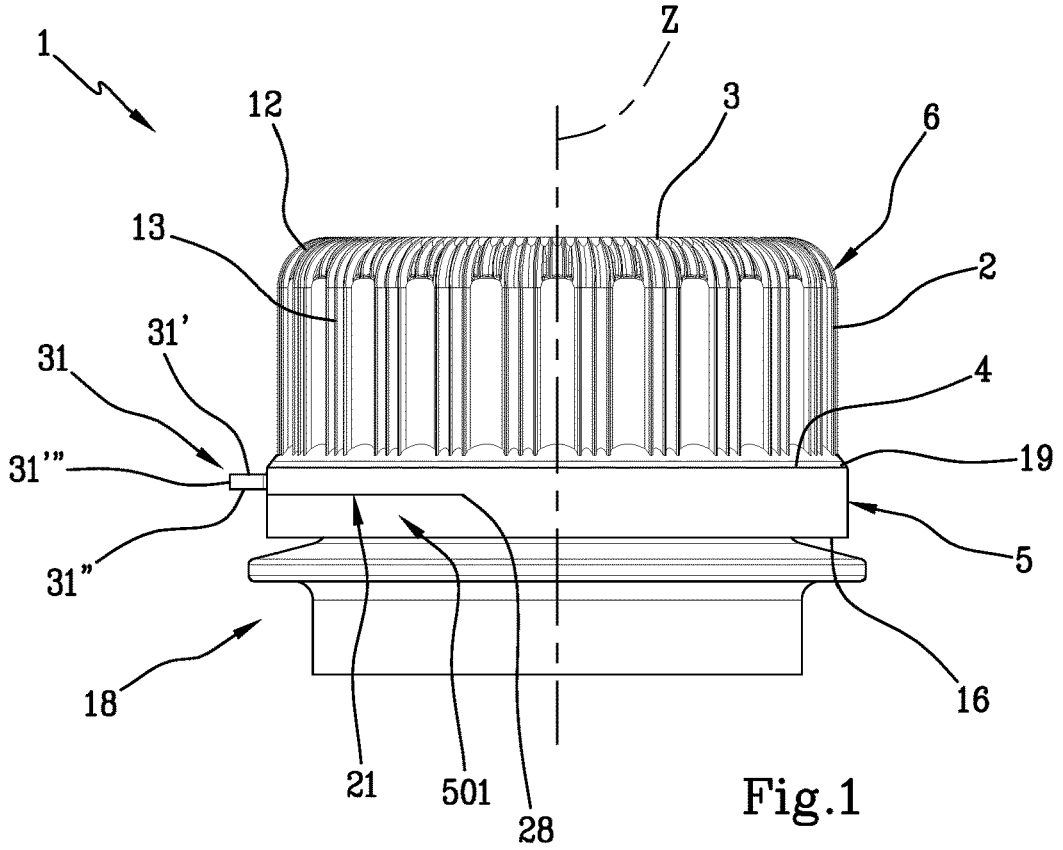
FIG. 1 is a side view of a cap for a container, in a closed position, applied on a neck of a container and comprising a projection positioned between a separation line and an incision line.

The cap 1 is shown in FIG. 1 in a closed position in which the cap 1 is found when it leaves a cap production line, ready to be applied on a container, not illustrated. In this condition, the cap 1 comprises a side wall 2 which extends about an axis Z, and a transversal wall 3 arranged at an end of the side wall 2, so as to close that end. The transversal wall 3 extends transversally, in particular perpendicularly, to the axis Z. The transversal wall 3 can be flat, even though other shapes are theoretically possible. In the example illustrated, the transversal wall 3 has a substantially circular shape in plan view.

The side wall 2 and the transversal wall 3 define a concave body.

In detail, the side wall 2 is shaped like a skirt which extends about the axis Z. In particular, the side wall 2 is connected to the transversal wall 3 by a connecting zone 12, which can be shaped, in cross section, like a bevelled edge or a circular connection.

The cap 1 is provided with a separation line 4, positioned on the side wall 2 and extending about the axis Z. The separation line 4 extends in a separation plane positioned transversally, in particular perpendicularly, to the axis Z. The separation line 4 defines on the cap 1 a retaining ring 5 and a closure element 6. The latter are positioned on opposite sides of the separation line 4. As described in more detail below, when the cap 1 is moved to an open position, the closure element 6 separates from the retaining ring 5 along the separation line 4.

The retaining ring 5 is intended to remain anchored to a neck 18 of the container, being configured to internally engage with an enlargement 23 of the neck 18. The closure element 6 can removably engage the neck 18 so as to open or close the container Along the separation line 4 there can be a plurality of breakable bridges (not illustrated) which connect the retaining ring 5 to the closure element 6. The breakable bridges are intended to be broken the first time the cap 1 is moved to the open position, to signal that the container is no longer whole.

The separation line 4 can be parallel to a free edge 16 of the cap 1. More specifically, the free edge 16 delimits the retaining ring 5 on the opposite side to the transversal wall 3.

The separation line of 4 does not extend for an entire angle of 360° about the axis Z. The separation line 4 is interrupted in the circumferential direction, so as to define on the side wall 2 a joining portion 8, at which the closure element 6 remains joined to the retaining ring 5.

In other words, the separation line 4 has a first end 9 and a second end 10.

The joining portion 8 is interposed between the first end 9 and the second end 10. At the joining portion 8, the retaining ring 5 is joined to the closure element 6.

Figure 2:
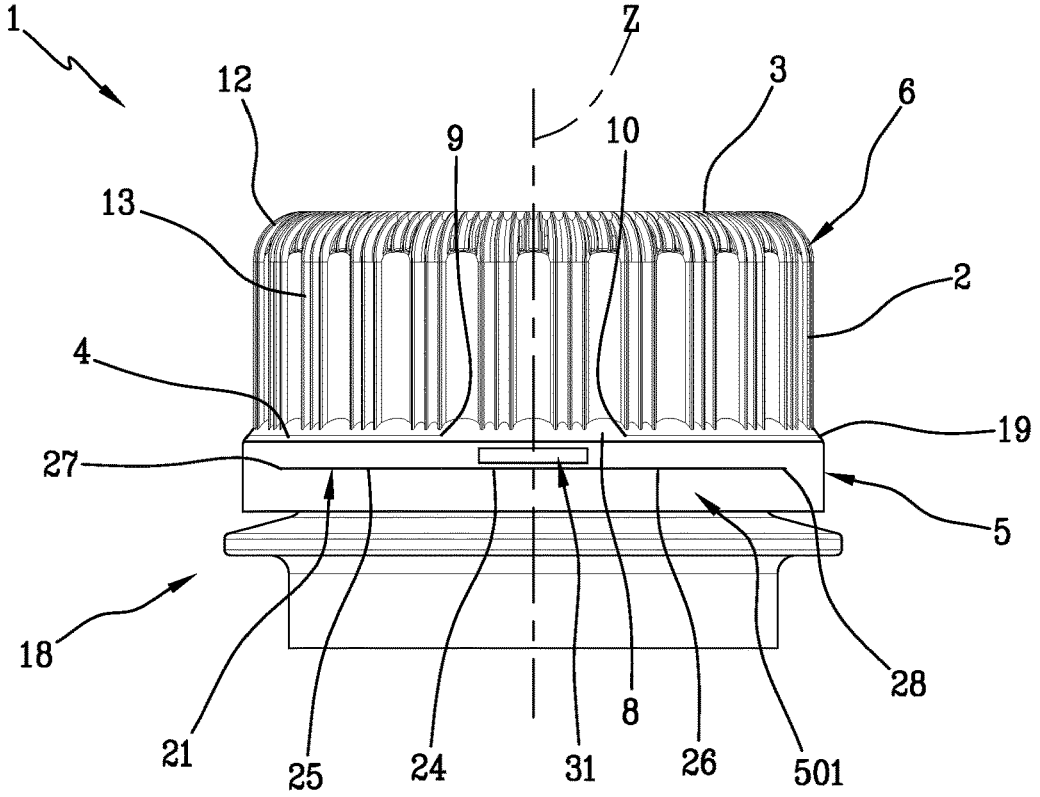
FIG. 2 is a front view of the cap of FIG. 1, in the closed position.

As shown in FIG. 2, the joining portion 8 extends about the axis Z for a predetermined angular dimension.

Figure 8:
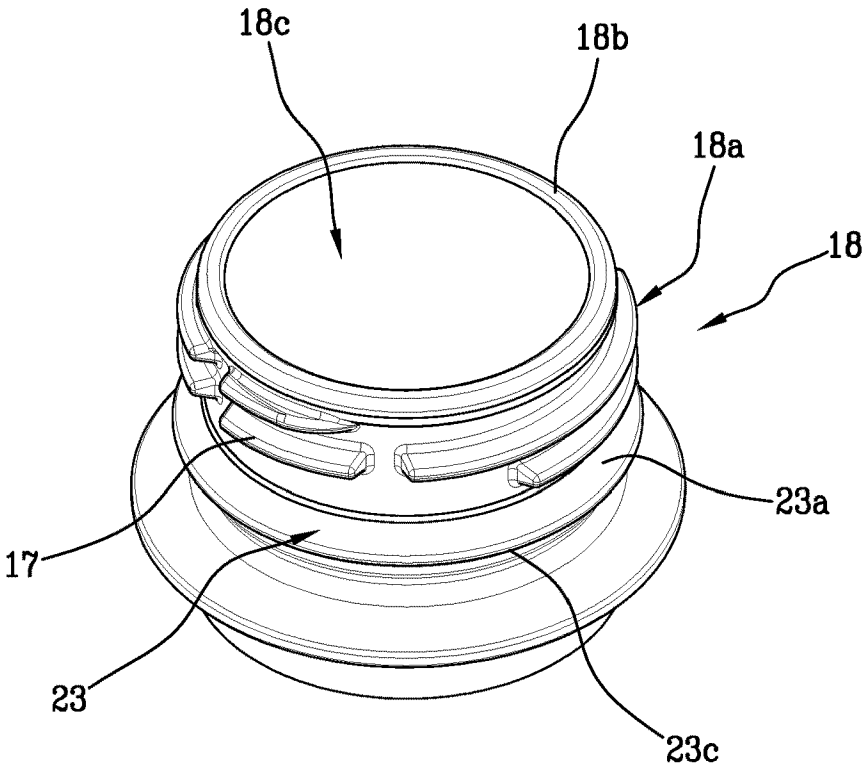
FIG. 8 is a perspective view of the neck of FIG. 7.
Figure 7:
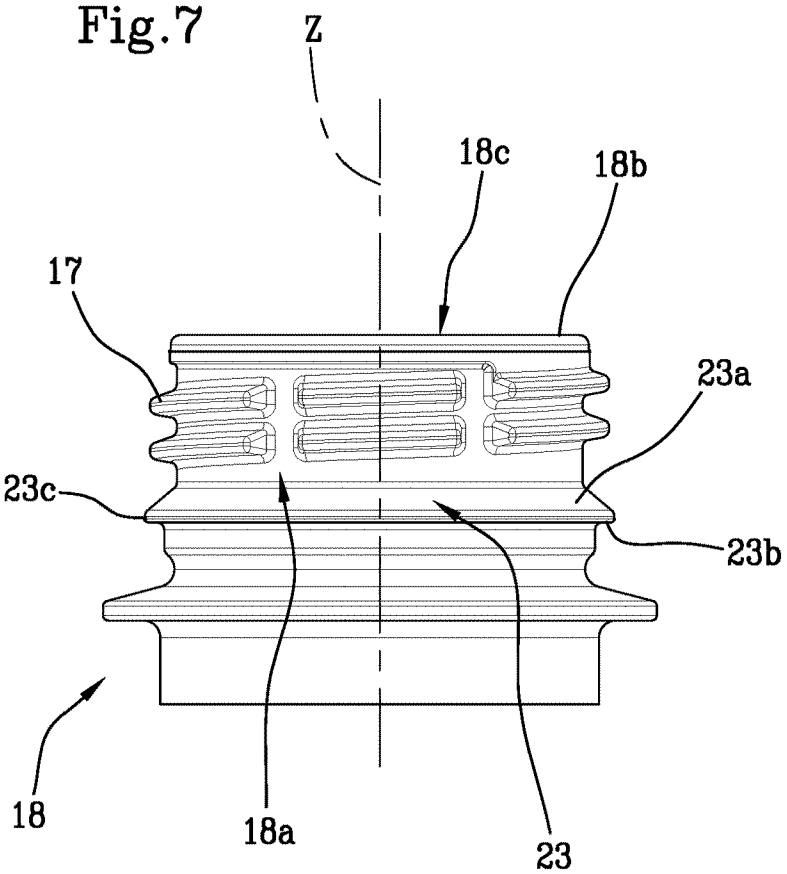
FIG. 7 is a side view of a neck on which a cap according to this invention can be screwed.

The joining portion 8 defines a hinge band about which the closure element 6 can rotate after disengaging from the neck 18, shown in more detail in FIGS. 7 and 8, of the container on which the cap 1 is applied.

This hinge band extends between two opposite end zones of the joining portion 8, that is to say, it extends from a zone of the joining portion 8 immediately adjacent to the first end 9 to a zone of the joining portion 8 immediately adjacent to the second end 10.

The hinge band defined by the joining portion 8 therefore affects the entire angular dimension of the joining portion 8, without the interposing of arrow shaped hinges or of reduced thickness zones.

In the example illustrated, the closure element 6 is also shaped like a cup-shaped body.

The side wall 2 is provided, on an inner surface thereof, with removable fixing means, not illustrated, by means of which the closure element 6 can removably engage with the neck 18 of the container. The removable fixing means can comprise, for example, an inner thread intended to engage with an outer thread 17 made on the neck 18.

The side wall 2 can be provided, on an outer surface thereof, with a plurality of knurling lines 13, extending parallel to the axis Z and suitable for aiding gripping of the cap 1 by the user or by the capping machine which applies the cap 1 on the container to be closed. The knurling lines 13 can also continue in the connecting zone 12 and/or in the retaining ring 5.

In the example illustrated, the side wall 2 comprises a cylindrical portion on which the knurling lines 13 are made and a widened portion having a diameter greater than that of the cylindrical portion. The widened portion can be delimited by a smooth outside surface, that is to say, it can be free of knurling lines. However, this condition is not necessary and the knurling lines could also extend on the widened portion. Between the cylindrical portion and the widened portion there can be a step 19.

The retaining ring 5 extends between the free edge 16 and the separation line 4. The retaining ring 5 can be delimited by a cylindrical or frustoconical outer surface. In the closed position of the cap 1 shown in FIGS. 1 and 2, the retaining ring 5 is coaxial relative to the closure element 6.

Figure 3:
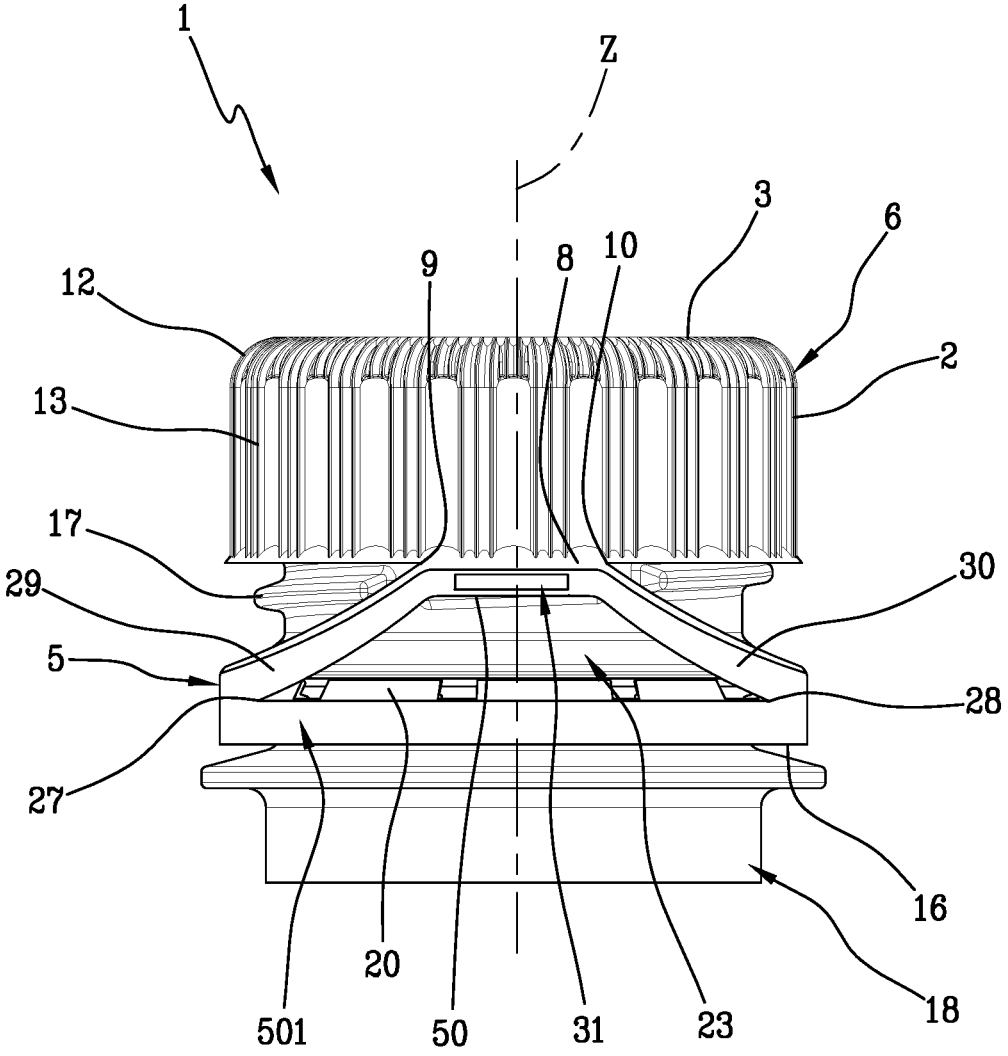
FIG. 3 is a front view like that of FIG. 2, in a spaced apart configuration wherein a closure element of the cap is separated from a retaining ring.

The retaining ring 5 is internally provided with an engagement element 20, shown at least in FIG. 3, suitable for engaging with the enlargement 23, shown at least in FIGS. 3 to 8, which is circular and projects from an outer surface of the neck 18. The engagement element 20 is configured to make contact against the circular enlargement 23 so as to prevent axial movements of the retaining ring 5, away from the neck 18, when the closure element 6 is removed from the neck 18.

The neck 18, shown in more detail in FIGS. 7 and 8, is delimited by an outer surface 18*a*, which in the example illustrated is cylindrical and coaxial with the longitudinal axis Z which when the cap 1 is applied on the neck 18 of the container in the closed position coincides with the longitudinal axis Z of the cap 1.

The outer surface 18*a* extends as far as a rim 18*b*, which surrounds an opening 18*c* through which it is possible to access the container, when the closure element 6 is in the open position. Vice versa, the closure element 6 closes the opening 18*c* when it is positioned in the closed position.

Projecting from the outer surface 18*a* is the circular enlargement 23 suitable for engaging with the engagement element 20 provided inside the retaining ring 5 so as to prevent the retaining ring 5 from being detached from the neck 18.

The circular enlargement 23 can be frustoconical, its diameter increasing along a line moving away from the rim 18*b*, and can therefore comprise an upper wall 23*a*, which is facing towards the rim 18*b*.

However, other geometries of the circular enlargement 23 are possible.

The circular enlargement 23 also comprises a lower wall 23*b*, facing the opposite way to the rim 18*b*, against which the at least one engagement element of the retaining ring 5 makes contact.

The upper wall 23*a* moves away from the rim 18*b* as far as a respective outer end 23*c* which forms an outer rim for the enlargement 23.

The neck 18 also comprises the outer thread 17 made on the outer surface 18*a* and which protrudes from the outer surface 18*a*.

The cap 1 is intended to be applied on the neck 18 when the closure element 6 is in the closed position. The cap 1 is in particular applied on the neck 18 in such a way that the engagement element 20 provided inside the retaining ring 5 is below the circular enlargement 23.

The engagement element 20 can be shaped like an annular element, not illustrated, which is bent around the free edge 16 inwards towards the inside of the retaining ring 5. In detail, the annular element can be continuous or interrupted. Indeed, there can be a plurality of bent elements, shown in FIG. 3, shaped like tabs, which project from the free edge 16 and are bent inwards towards the inside of the retaining ring 5 to form the engagement element 20. Alternatively, according to an embodiment not illustrated, the engagement element 20 can be shaped like an enlargement, continuous or interrupted, which from an inner surface of the retaining ring 5 projects towards the axis Z to engage with the circular enlargement 23.

As shown in FIG. 1, the cap 1 has an incision line 21 which extends on the side wall 2 transversally, in particular perpendicularly, to the axis Z. In more detail, the incision line 21 is interposed between the separation line 4 and the free edge 16 and can lie in a plane transversal, in particular perpendicular to the axis Z.

If the cap 1 is positioned in the same orientation which it will have after having been applied to the container, that is to say, with the transversal wall 3 facing upwards, the incision line 21 is positioned below the separation line 4.

The retaining ring 5 comprises a retaining portion 501, which is configured to internally engage with the circular enlargement 23 of the neck 18 and extends between the incision line 21 and the free edge 16 of the retaining ring 5.

The incision line 21 therefore delimits the retaining portion 501 on the opposite side to the free edge 16.

The joining portion 8 is positioned on the opposite side of the incision line 21 to the retaining portion 501.

The incision line 21 therefore delimits the joining portion 8 towards the retaining portion 501.

The incision line 21 has an angular extent, measured about the axis Z, greater than the angular distance (also measured about the axis Z) between the first end 9 and the second end 10 of the separation line 4, that is to say, the angular dimension of the joining portion 8. For example, the angular extent of the incision line 21 can be between 60° and 200°, preferably between 75° and 180°.

The angular dimension of the joining portion 8 about the axis Z, that is to say, the circumferential angular distance between the first end 9 and the second end 10 of the separation line 4, can be greater than, or equal to, 20° and less than, or equal to, 120°, preferably greater than, or equal to, 25° and less than, or equal to, 90°.

In the example illustrated, the joining portion 8 is centred relative to the separation line 21. In other words, the midpoint of the separation line 21 and the centre line of the joining portion 8 are aligned with each other along a line parallel to the axis Z, that is to say, they lie in a common plane which contains the axis Z. However, this condition is not necessary, since even a not perfectly centred positioning of the incision line 21 relative to the joining portion 8 is permitted.

In the example illustrated, the incision line 21 has a flat curved shape which lies in a plane. However, other shapes are possible.

The incision line 21 and the separation line 4 can be parallel to each other, even though this condition is not necessary. For example, the incision line 21 and the separation line 4 could be slightly inclined relative to each other.

Alternatively, the incision line 21 could comprise a plurality of stretches having different inclinations, not necessarily parallel to each other.

As shown at least in FIG. 2, the incision line 21 has an end 27 and a further end 28. The end 27 extends angularly outside the joining portion 8, beyond the first end 9 of the separation line 4. The further end 28 also extends angularly outside the joining portion 8, but goes beyond the second end 10 of the separation line 4.

The incision line 21 comprises a central stretch 24 interposed between a peripheral stretch 25 and a further peripheral stretch 26. The central stretch 24 faces the joining portion 8. The peripheral stretch 25 faces the separation line 4, in particular an end portion of the separation line 4. More precisely, the peripheral stretch 25 faces the separation line 4 in a zone between the first end 9 of the separation line 4 and the end 27 of the incision line 21. The further peripheral stretch 26 faces the separation line 4, in particular a further end portion of the separation line 4. More precisely, the further peripheral stretch 26 faces the separation line 4 in a zone between the second end 10 of the separation line 4 and the further end 28 of the incision line 21.

Defined between the peripheral stretch 25 of the incision line 21 and the portion of the separation line 4 which starts from the first end 9, there is a connecting band 29 for connecting the joining portion 8 to the retaining ring 5. Similarly, defined between the further peripheral stretch 26 of the incision line 21 and the further portion of the separation line 4 which starts from the second end 10, there is a further connecting band 30 for connecting the joining portion 8 to the retaining ring 5. The connecting bands 29 and 30 are shown at least in FIG. 3.

The peripheral stretch 25 and the further peripheral stretch 26 respectively define a free lower edge and a further free lower edge respectively of the connecting band 29 and of the further connecting band 30, and can lie in the same plane in which the central stretch 24 of the incision line 21 lies or, have different inclinations.

In the example illustrated, the connecting band 29 and the further connecting band 30 are positioned symmetrically to each other relative to a plane containing the axis Z and a centre line of the joining portion 8.

The connecting bands 29, 30 are deformable, for allowing the joining portion 8 to rotate when the closure element 6 is moved from a closed position to an open position.

The incision line 21 can be shaped like a through incision which passes through the entire thickness of the side wall 2. Even if this feature is not shown in the Figures, along the incision line 21 there can optionally be one or more breakable elements intended to break the first time the cap 1 is opened.

Alternatively, the incision line 21 can be shaped as a weakening line which does not pass through the entire thickness of the side wall 2, but at which the thickness of the side wall 2 is reduced compared with the surrounding zones.

At the first end 9 and the second end 10 of the separation line 4, and/or the end 27 and the further end 28 of the incision line 21, there can optionally be incision zones, not illustrated. The incision zones can have a circular geometry and in general have a transversal dimension greater than a width of the corresponding incision line or separation line. This makes it possible to prevent the propagation of fracture cracks starting from the incision or separation lines.

In a central part of the joining portion 8 there can optionally be a reduction incision, not illustrated, having dimensions which are very limited relative to the dimensions of the joining portion 8, so as to not adversely affect the strength of the joining portion 8. The reduction incision makes it possible to increase the deformability of the central part of the joining portion 8, reducing the tensions in the surrounding zones.

The cap 1 is applied to the neck 18 of the container in the closed position shown in FIGS. 1 and 2. The cap 1 is positioned in such a way that the engagement element 20 provided inside the retaining ring 5 is below the circular enlargement 23 present on the neck 18.

It should be noticed that, as is shown more clearly in FIG. 3, the joining portion 8 is delimited at the bottom by an edge 50 which, in the closed position of the closure element 6 (and in general before the closure element 6 is rotated relative to the retaining ring 5 to be moved to the open position) faces the retaining portion 501 of the retaining ring 5. More specifically, the edge 50 is defined by the incision line 21.

In accordance with the invention, the joining portion 8 is externally provided with a projection 31 which projects from the joining portion 8 itself and is positioned between the separation plane in which the separation line 4 lies and the incision line 21 so that, when the closure element 6 is in the open position and the connecting bands 29, 30 keep the closure element 6 connected to the retaining ring 5, the edge 50 of the joining portion 8 which, in the closed position, faces the retaining ring 5, is facing, in the open position, towards the rim 18*b* of the neck 18 and the projection 31 is resting on the neck 18, in said open position.

In more detail, the projection 31 is positioned, at least partially, between the central stretch 24 of the incision line 21, facing the joining portion 8, and the separation plane.

When the closure element 6 passes from the closed position to the open position, the joining portion 8 is overturned relative to the neck 18.

Figure 4:
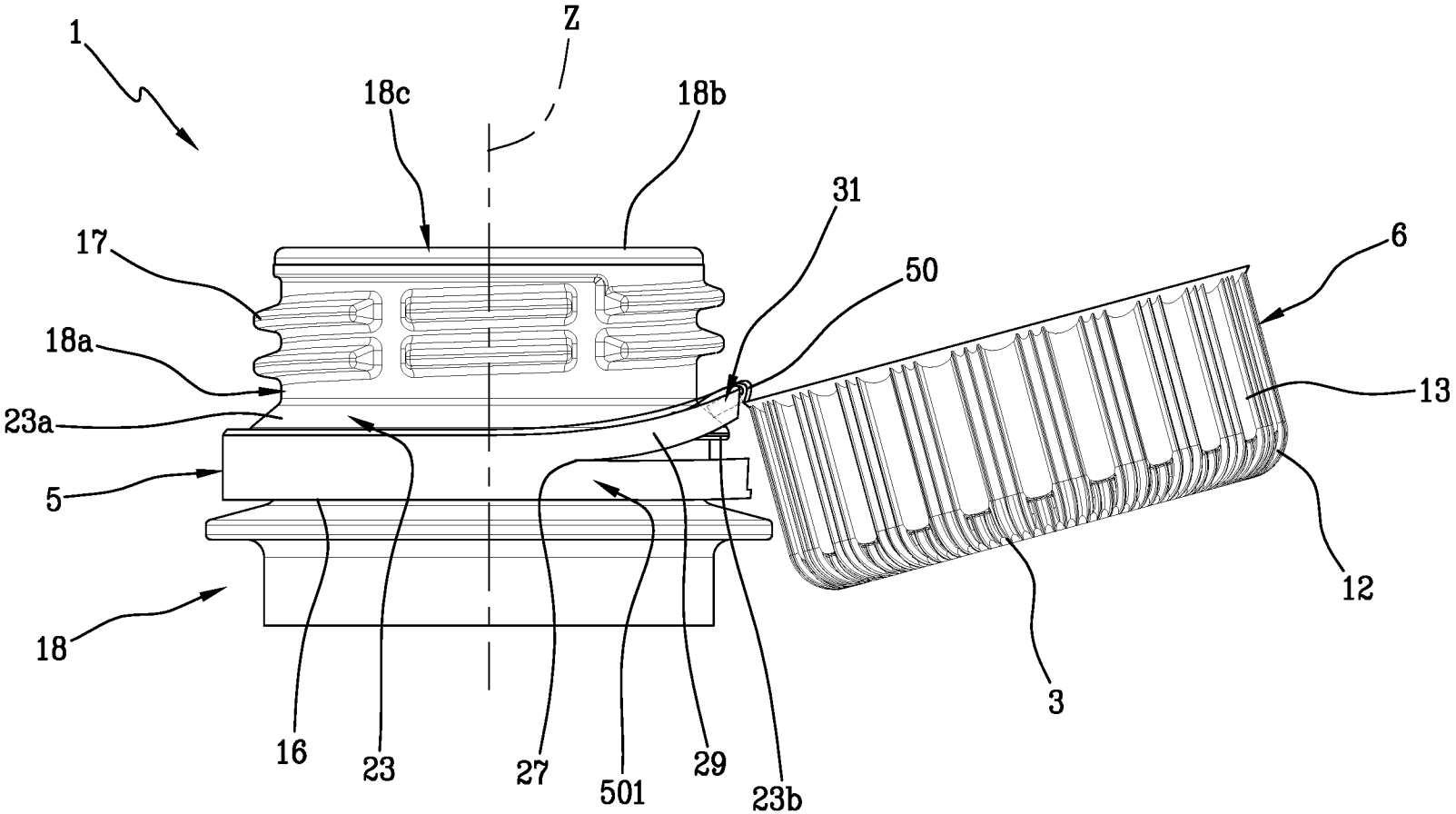
FIG. 4 is a side view of the cap of FIG. 1, in an open position wherein the projection of the cap is resting on an upper wall of an enlargement of the neck, since the projection is nearer the incision line than the separation line.
Figure 5:
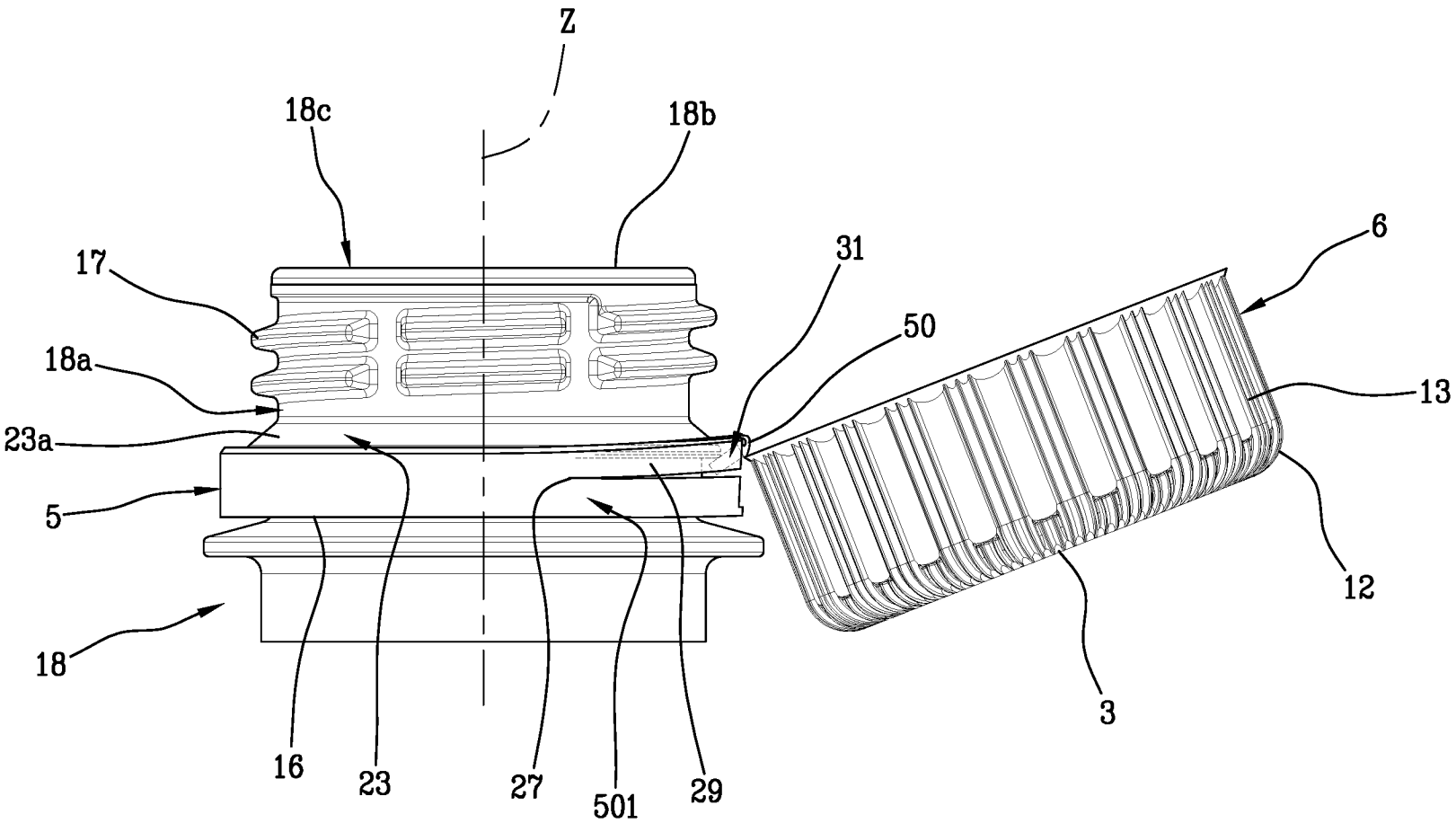
FIG. 5 is a side view of an embodiment of the cap of FIG. 1, in the open position, wherein the projection of the cap makes contact with a lower wall of the enlargement of the neck, since the projection is nearer the separation line than the incision line.

Consequently, the edge 50, which in the closed position was facing the retaining ring 5, is positioned in such a way that it is facing towards the rim 18*b* of the neck 18, that is to say, upwards in FIGS. 4 and 5.

The connecting bands 29 and 30, which are deformable, are subjected to a twisting movement when the closure element is moved from the closed position to the open position, which can affect at least one part of the axial dimension of each connecting band, defined as the dimension of the connecting band along a line parallel to the axis, in the closed position of the closure element.

The projection 31 operates in conjunction with the overturning of the joining portion 8 and can render the closure element 6 stable and lock it on the neck 18, preventing the connecting bands 29 and 30 from performing the twisting movement in the opposite direction.

As already indicated, the joining portion 8 extends for an angle about the axis Z of the side wall 2 which has a dimension, greater than, or equal to, 20°, and less than, or equal to, 120°, and preferably greater than, or equal to, 25° and less than, or equal to, 90°.

In this way, the joining portion 8 is not too wide about the axis Z of the side wall, which would make it difficult for the joining portion 8 to overturn, that is to say, for its edge 50 to pass from a configuration facing the retaining portion 501, to a configuration facing towards the rim 18*b* of the neck 18.

At the same time, the joining portion 8 is not too narrow about the axis of the side wall 2, which could generate an interference, between the joining portion 8 and the neck 18, which is not sufficient to keep the closure element 6 stably in the open position.

It should be noticed that the projection 31 projects from a base of the side wall 2 which extends for a respective angle which has a dimension, about the axis Z greater than, or equal to, 4° and less than, or equal to, 90°. The term base of the projection 31 refers to an area of the side wall 2, from which the projection 31 protrudes.

Preferably, the projection 31 is centrally positioned in the joining portion 8, that is to say, it is centrally positioned relative to a plane containing the axis Z and a centre line of the joining portion 8.

The projection 31, as shown in FIG. 1, has an upper wall 31', which in the closed position faces towards the transversal wall 3, a lower wall 31", which in the closed position faces towards the free edge 16, and an end edge 31'" which is the end edge of the projection 31.

The projection 31 can have a thickness greater than, or equal to, 0.4 mm, and less than, or equal to 4.0 mm.

With regard to this, the thickness of the projection 31 can be appropriately selected, as described in more detail below, in order to be able to select where one prefers the projection 31 to make contact with the neck 18.

The thickness of the projection 31 is measured, in the closed position, along a line parallel to the axis Z.

The thickness of the projection 31 can be constant along the entire angle of extension of the projection 31 about the axis Z, or the projection 31 can have a variable thickness about the axis Z.

Advantageously, the projection 31 projects from the side wall 2 for a height which is less than, or equal to 4.0 mm.

In the closed position, the height of the projection 31 is measured along a line transversal, in particular perpendicular to the axis Z, that is to say, radially if considering that the side wall 2 has a cylindrical shape.

The height can be constant for the entire angle of extension of the projection 31 about the axis Z or the height of the projection 31 can be variable along the entire angle of extension of the projection 31 about the axis Z to define a projection 31 having an end edge 31'" which is concave, or convex, or interrupted, or planar.

For example, the end edge 31'" can lie in a plane and, therefore, be planar, the height of the projection 31 along the end edge 31'" varying about the axis Z.

Figure 14:
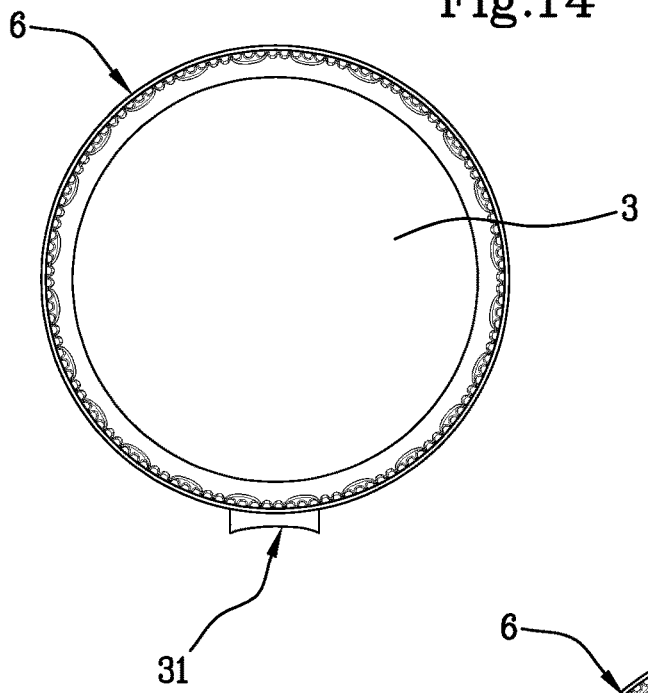
FIG. 14 is a top view of a variant of the cap of FIG. 1, wherein the projection has a concave shape.

As illustrated in FIGS. 14 to 16, the end edge 31''' of the projection 31 can have a concave shape.

The end edge 31''' can be continuous, as illustrated in FIG. 14, or, as illustrated in FIG. 15, it can optionally be interrupted.

In other words, the projection 31 can have a plurality of portions, wherein some portions 34' have a predetermined height and other portions 34" have a height close to 0 and are positioned between two portions 34' having predetermined height, in such a way that the projection 31 has an end edge 31''' which is interrupted, but which as a whole has the desired shape.

To ensure that the end edge 31''' has the concave and interrupted shape of FIGS. 15 and 16, each portion 34' having predetermined height has a height which, angularly, can be variable. However, alternatively, according to a further variant not illustrated, each portion 34' can have a respective straight portion of the end edge, but this has a height which is variable between the different portions 34'.

Figure 17:
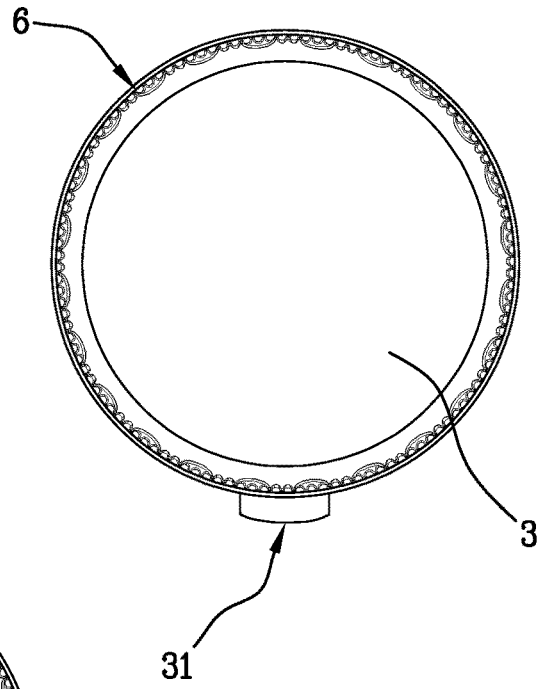
FIG. 17 is a top view of a further variant of the cap of FIG. 1, wherein the projection has a convex shape.
Figure 18:
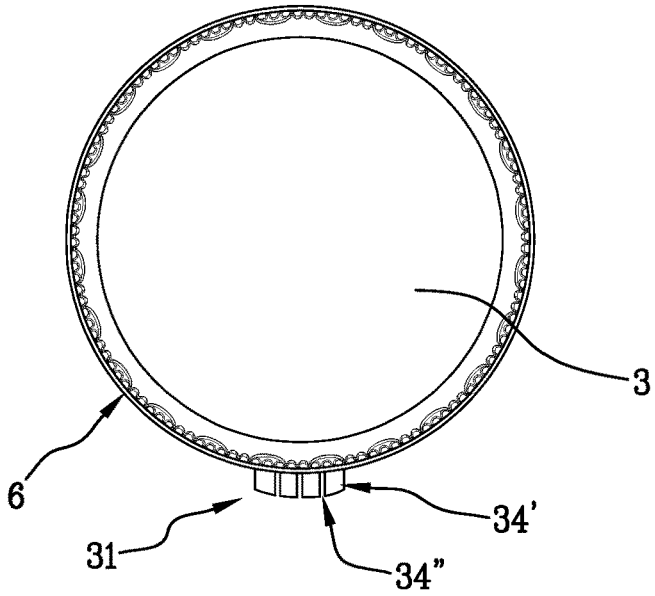
FIG. 18 is a top view of a further other variant of the cap of FIG. 1, wherein the projection has a convex shape and is interrupted.

If the portions 34" having a height close to 0 also have a thickness equal to 0, this means that the projection 31 has zones in which it is angularly absent. As illustrated in FIGS. 17 and 18, the end edge 31''' of the projection 31 differs from that of FIGS. 14 to 16 since it has a convex shape.

The end edge 31''' can be continuous, as illustrated in FIG. 17, or, as illustrated in FIG. 18, it can optionally be interrupted and have a plurality of portions 34, similarly to what has already been indicated and will not be repeated in detail here, wherein some portions 34' have a predetermined variable height and other portions 34" have a height close to 0, in such a way that the projection 31 has an end edge 31''' which is interrupted, but which as a whole has the desired shape, in this case convex.

The thickness of the projection 31 can be variable along the height. For example, in one embodiment not illustrated, the projection 31 can be tapered and have the end edge 31''' with reduced thickness, relative to the thickness of the projection 31 at the base, despite the thickness being constant along the entire angle of extension of the projection about the axis Z.

For example, in another embodiment not illustrated, the projection 31 can have respective bevelled or rounded edges between the upper wall 31' and the end edge 31''' and/or between the end edge 31''' and the lower wall 31", to improve the ergonomics and avoid sharp edges which could cause uncomfortable sensations for the user.

The projection 31 is preferably angularly elongate, that is to say, has an angular extent about the axis Z, which defines a length of the projection 31 which is greater than the thickness. However, the thickness and/or the height and/or the length can be appropriately selected.

Considering the closure element 6 in the closed position, the position of the projection 31 in the joining portion 8 can be axially moved along a line parallel to the axis Z, that is to say, the projection 31 can be positioned nearer the separation line 4 or nearer the incision line 21, depending on the type of cap 1, or on the type of neck 18 for which the cap is intended.

If the projection 31 is nearer the incision line 21 than the separation line 4, as shown in FIG. 4, the end edge 31''' of the projection 31 is configured to be positioned resting on the neck 18, for example above the enlargement 23 or on the upper wall 23*a* of the enlargement 23, in the open position.

In FIG. 4, it should be noticed that the end edge 31''' makes contact with the neck immediately above the upper wall 23*a* del enlargement 23.

In this way, when the closure element 6 passes from the closed position to the open position, the joining portion 8 overturns relative to the neck 18 and the end edge 31''' of the projection 31 is positioned resting on the neck 18, locking the closure element 6.

In contrast, FIG. 5 shows an embodiment of the cap 1, in which the projection 31 is nearer the separation line 4 than the incision line 21. Indeed, the lower wall 31" of the projection 31 is configured to be positioned below the enlargement 23 in the open position, for example to make contact with the lower wall 23*b* of the enlargement 23.

In this way, the projection 31 is locked on the neck 18 since the projection 31 is prevented from axially moving towards the rim 18*b* of the neck 18 itself.

Figure 6:
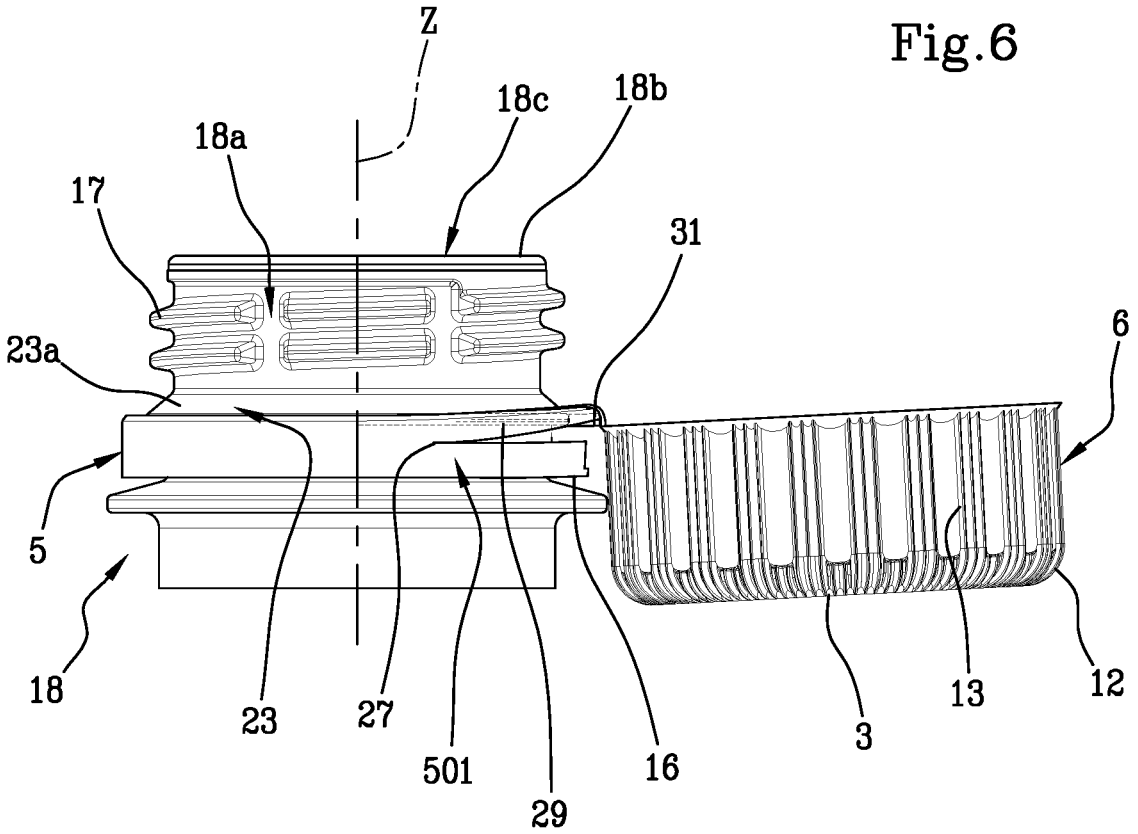
FIG. 6 is a side view of another embodiment of the cap of FIG. 1, in the open position, wherein the projection of the cap makes contact with an outer end of the enlargement of the neck.
Figure 13:
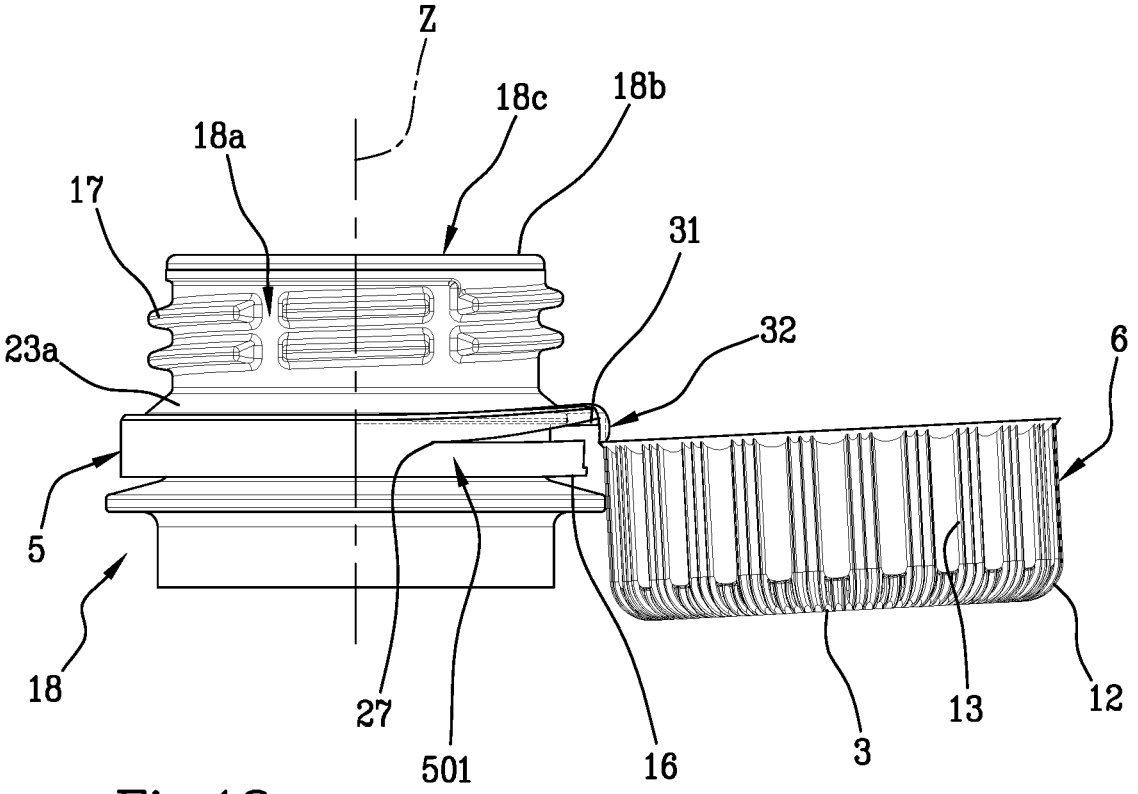
FIG. 13 is a side view of another embodiment of the cap of FIG. 9, in the open position, wherein the projection makes contact with the outer end of the enlargement of the neck.

In contrast, FIG. 6 shows another embodiment of the cap 1 in which the projection 31 is axially positioned in the joining portion 8 between the separation line 4 and the incision line 21 in such a way that the end edge 31''' of the projection 31 makes contact with the outer end 23*c* of the enlargement 23, in the open position.

In this way, the projection 31 is locked on the neck 18 since the joining portion 8 overturns relative to the neck 18 and the end edge 31''' of the projection 31 makes contact with the outer end 23*c* of the enlargement 23. Thanks to selection of the axial position of the projection 31 in the side wall 3, it is therefore possible to ensure that the projection 31 is positioned resting above, or below, or on an outer end 23*c* of the enlargement 23.

The projection 31 has a plane of symmetry which is positioned transversally, for example perpendicularly, to the axis Z, when the closure element 6 is in the closed position. In other words, the projection 31 projects perpendicularly outwards from the joining portion 8.

Between the projection 31 and the separation line 4, and between the projection 31 and the incision line 21 a first distance and a second distance are respectively measured which are the distances between the plane of symmetry of the projection 31 and the plane in which the separation line 4 lies, and between the plane of symmetry of the projection 31 and the plane in which the incision line 21 lies.

The projection 31 is nearer the separation line 4 if the second distance is greater than the first distance, the projection 31 is nearer the incision line 21 if the first distance is greater than the second distance.

In use, when the user wishes to open the container for the first time, the user grips the side wall 2 of the closure element 6 and rotates the closure element 6 about the axis Z, in order to unscrew the closure element 6 from the neck 18. Initially, the closure element 6 and the retaining ring 5 are rotated together about the axis Z, and they simultaneously move together along a line parallel to the axis Z, away from the neck 18. This occurs until the engagement element 20 of the retaining ring 5 makes contact against the circular enlargement 23 provided on the neck 18. At this point, the circular enlargement 23 prevents the retaining ring 5 from rising further along the axis Z, acting as a stop for the movement of the retaining ring 5 away from the neck 18.

The closure element 6, which is unscrewed by the user, continues to move along the axis Z away from the neck 18. The breakable bridges are thereby tensioned, until causing them to break. The closure element 6 consequently separates from the retaining ring 5 along the separation line 4, but remains joined to the retaining ring 5 at the joining portion 8.

If the user continues to unscrew the closure element 6, so as to move the closure element 6 along the axis Z to remove it from the neck 18, the first connecting band 29 and the second connecting band 30 deform. In particular, by moving the closure element 6 upwards, the first connecting band 29 and the second connecting band 30 are also pulled upwards. Consequently, the first connecting band 29 and the second connecting band 30 are spaced apart from both the closure element 6 and the retaining ring 5 and remain joined to each other in the joining portion 8.

The first connecting band 29 and the second connecting band 30 thus adopt a kind of trapezium shape as shown in FIG. 3. In this configuration, the first connecting band 29 remains joined to the retaining ring 5 at the end 27 of the incision line 21. Similarly, the second connecting band 30 remains joined to the retaining ring 5 at the further end 28 of the incision line 21.

In other words, the first connecting band 29 and the second connecting band 30 are positioned in an inclined configuration relative to the retaining ring 5 and converge in the joining portion 8, as shown in FIG. 3.

Continuing to unscrew the closure element 6, the latter is disengaged from the outer thread 17 made on the neck 18, so that the container can be opened. The retaining ring 5, more specifically the connecting portion 501, in contrast remains anchored to the neck 18. The first connecting band 29, the second connecting band 30 and the joining portion 8 form a hinge arrangement, not illustrated, about which the closure element 6 can rotate to allow the user to access the contents of the container.

In particular, by moving the closure element 6 about the hinge arrangement after the closure element 6 has been disengaged from the neck 18, it is possible to move the closure element 6 to a lateral position relative to the neck 18, so that the closure element 6 is no longer coaxial with the retaining ring 5. The closure element 6 can be rotated further backwards so as to move it further away from the neck 18 and to allow the user to more easily access the contents of the container.

During the passage to the open position, the connecting bands 29 and 30, are subjected to a movement which is at least partially twisting and the projection 31 operates in conjunction with them and with the overturning of the joining portion 8 locking the closure element 6 on the neck 18 since it prevents the connecting bands 29 and 30 from performing the twisting movement in the opposite direction.

By making contact with the enlargement 23 as previously indicated, that is to say, by positioning itself resting on the upper wall 23*a* or making contact with its lower wall 23*b*, or the outer end 23*c*, the projection 31 locks the closure element 6 on the neck 18.

After use, the user can return the cap 1 to the closed position shown in FIG. 1 by means of a sequence of operations in reverse order compared with that previously described.

The first connecting band 29 and the second connecting band 30 allow a hinge arrangement to be obtained which is longer than that which would be available if only the hinge band defined by the joining portion 8 were present. This makes it easier to disengage the closure element 6 from the neck 18, by sliding the projection 31 on the enlargement 23, if the projection was resting on the neck 18 or on the enlargement 23, or disengaging the projection 31 from below the enlargement 23 or from its outer end 23*c*, if the projection 31 was engaged below the enlargement 23 or on its outer end 23*c*, to re-apply the closure element 6 on the neck 18, by rotating the closure element 6 about the hinge arrangement.

Therefore, advantageously, the user can perceive when the projection 31 is stably engaged on the enlargement 23 both in the passage from the closed position to the open position and vice versa in the passage from the open position to the closed position.

FIGS. 9 to 13 and show a cap 101 according to another embodiment.

The parts of the cap 101 common to the cap 1 described with reference to FIGS. 1 to 8 will be indicated with the reference numbers already used in FIGS. 1 to 8 and, for brevity, will not be described again in detail. What was previously described with reference to the cap 1 shall be understood to also be applicable to the cap 101, unless differences are explicitly provided.

According to this embodiment, the cap 101 differs from the cap 1 previously described because the joining portion 8 comprises a tab 32 which projects towards the free edge 16.

Indeed, the cap comprises an incision line 21' which in turn comprises a central stretch 24' which is interposed between a peripheral stretch 25' and a further peripheral stretch 26', wherein the peripheral stretch 25' and the further peripheral stretch 26' are aligned with each other and transversal to the axis Z and they extend in a first plane which is parallel to the separation plane, when the cap 101 is in the closed position.

The central stretch 24' extends in a second plane, parallel to the separation plane, which is interposed between the first plane and the free edge 16 of the retaining ring 5. In this way, the central stretch 24' defines a bottom edge 32*a* of the tab 32, which is made in the side wall 2 and projects towards the free edge 16 protruding relative to the connecting bands 29, 30.

Figure 10:
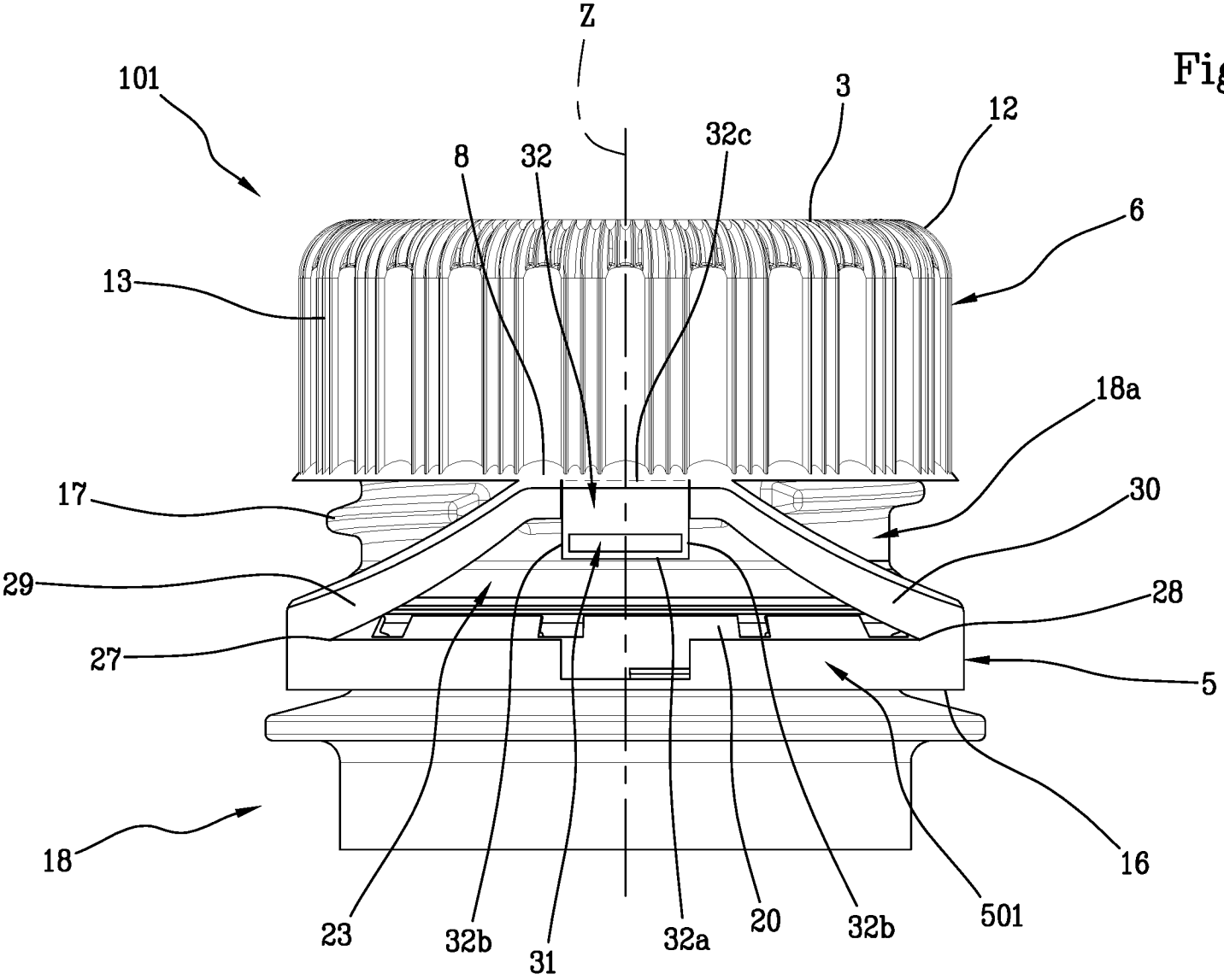
FIG. 10 is a front view of the cap of FIG. 9, in the spaced apart configuration wherein the closure element of the cap begins to be separated from the retaining ring.
Figure 11:
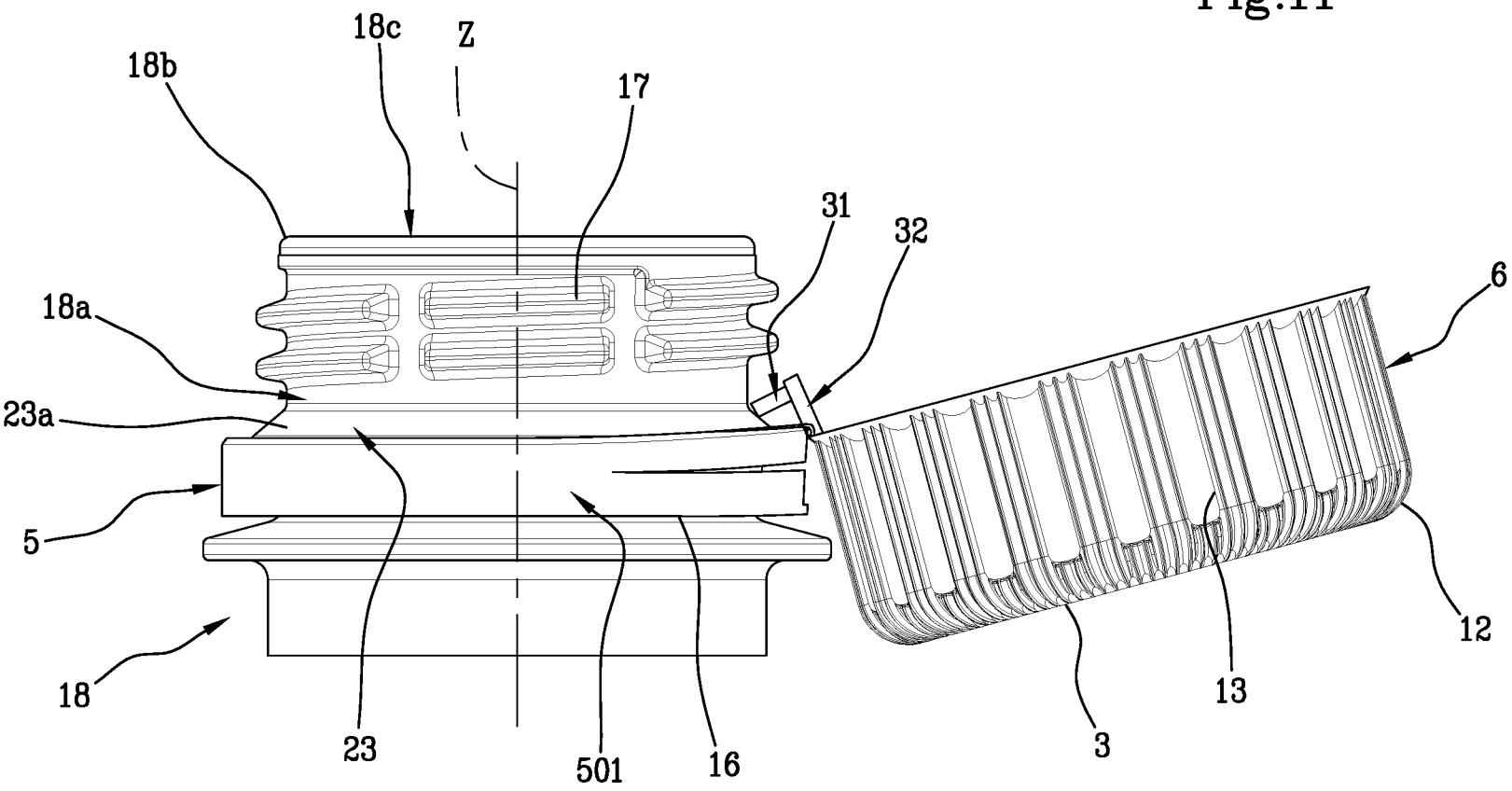
FIG. 11 is a side view of the cap of FIG. 9, in the open position, wherein the projection of the cap is resting on the upper wall of the enlargement of the neck, since the projection is nearer a central stretch of the incision line than the separation line.
Figure 12:
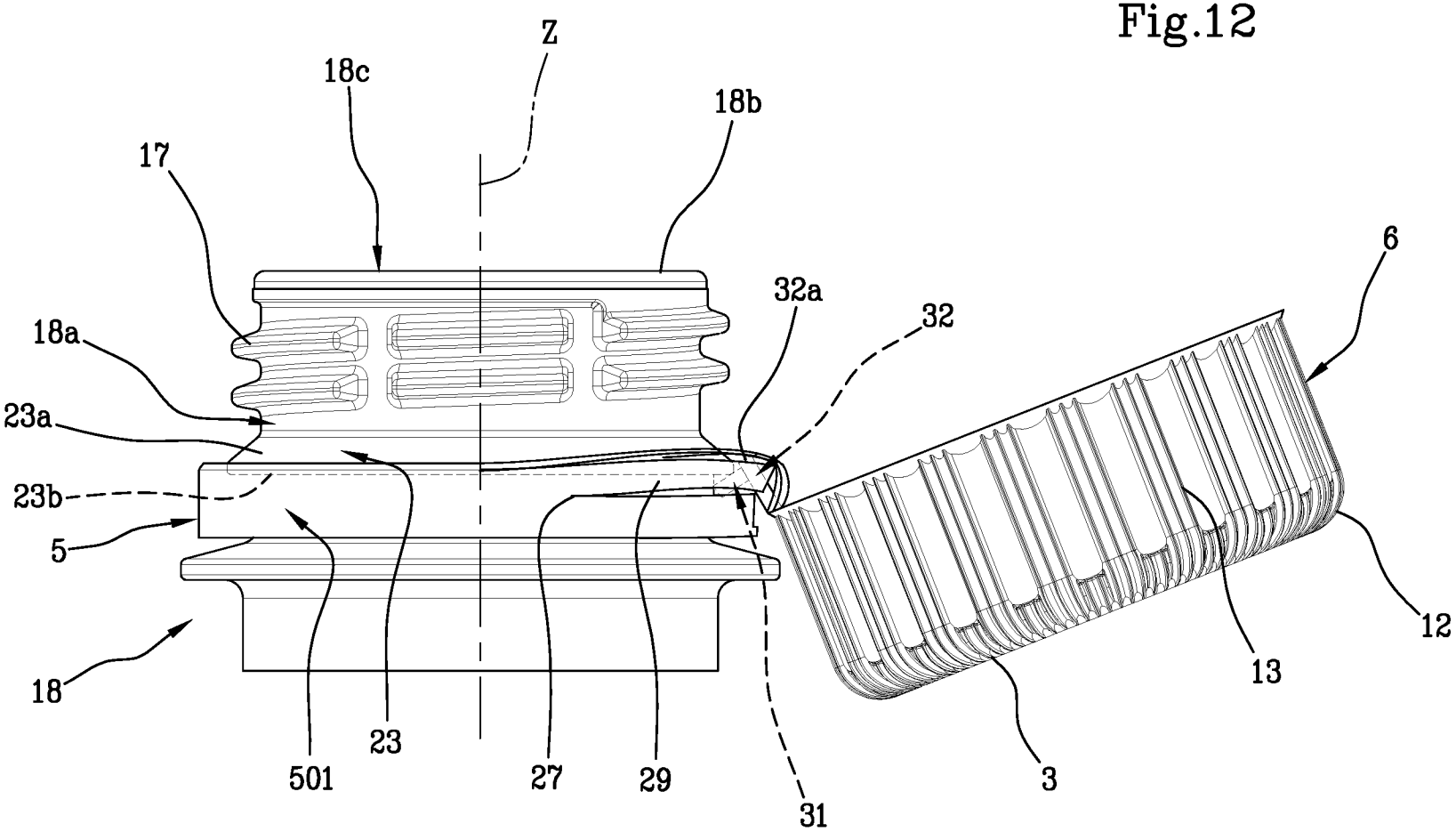
FIG. 12 is a side view of an embodiment of the cap of FIG. 9, in the open position, wherein the projection of the cap makes contact with the lower wall of the enlargement of the neck, since the projection is nearer the separation line than the central stretch of the incision line.

The tab 32 also has two side edges 32*b*, shown at least in FIG. 10, defined by a pair of cuts 33 provided on the side wall 2, which extend from opposite ends of the central stretch 24' towards the transversal wall 3. The cuts 33 extend parallel to the axis Z and are therefore perpendicular to the bottom edge 32*a* of the tab 32.

Circumferentially extending between the upper ends of the cuts 33 there is a hinge line 32*c* about which the tab 32 can optionally bend. It should be noticed that the hinge line 32*c* is a virtual line which in the side wall 2 defines a zone about which the tab 32 can optionally bend, for example in the passage in the closed condition to the open condition. In contrast, when the closure element 6 is in the open condition and is rotated relative to the neck 18 so that it rests on the neck 18 near the enlargement 23, the tab 32 does not bend but instead remains in line with the closure element 6.

In other words, the joining portion 8 comprises a tab 32 interposed between the connecting bands 29, 30 which protrudes towards the free edge 16 and can optionally bend about the hinge line 32*c*.

The cuts 33 also define an axial dimension of the tab 32, that is to say, a dimension of the tab 32 along a line which is parallel to the axis Z.

The cuts 33 can extend in the joining zone 8 as far as the separation plane or even, optionally, inside the closure element 6 if the tab 32 is to have a particularly significant axial dimension.

The projection 31 can be at least partially positioned in the tab 32, that is to say, be positioned in the joining portion 8 in such a way that part of the projection 31 is positioned, along an axis parallel to the axis Z, between the side edges 32*b* of the tab 32. However, preferably, the projection 31 can also be positioned inside the tab 32, that is to say, the projection 31 can be entirely contained in the tab 32, as shown in FIGS. 9 to 13.

Again in this case, as already described in detail, the projection 31 can be positioned nearer the incision line 21' than the separation line 4, or nearer the separation line 4 than the incision line 21'. What was previously indicated relative to the first distance and the second distance applies again, for establishing if the projection 31 is nearer the separation line 4 or the incision line 21'.

When the cap is in the closed position, the projection 31 can be positioned nearer the central stretch 24' of the incision line 21' which defines the bottom edge 32*a* of the tab 32, or nearer the separation plane.

The projection 31 can be positioned nearer the bottom edge 32*a* of the tab 32 than the separation line 4, so that an end edge 31''' of the projection 31 can be positioned resting on the neck 18 in the open position, for example above the enlargement 23, or on an upper wall 23*a* of the enlargement 23.

The projection 31 can also be positioned nearer the separation line 4 than the bottom edge 32*a* of the tab 32 so that the lower wall 31'' of the projection 31 can be positioned below the enlargement 18, for example to make contact with the lower wall 23*b* of the enlargement 23.

Alternatively, the projection 31 can be positioned in such a way that it makes contact with the outer end 23*c* of the enlargement 23, in the open position.

It should be noticed that positioned between the projection 31 and the side edges 32*b* of the tab 32 there can be a frame which surrounds the projection 31. In other words, the projection 31 is at a distance from the side edges 32*b* and a free frame is present delimited by the side edges 32*b* and by the bottom edge 32*a*.

However, depending on the type of technology used to make the incision line 21, between the projection 31 and the central stretch 24, or 24' of the incision line 21, there can be an axial distance equal to 0 or greater than 0, for example preferably greater than, or equal to, 0.3 mm.

Preferably, the plane of symmetry of the projection 31 is parallel to the bottom edge 32*a* of the tab 32, which are both perpendicular to the axis Z. In other words, the projection 31 projects perpendicularly from the tab 32.

As regards the shape of the projection 31 in the tab 32, what was previously said applies, that is to say, the projection 31 can have an angularly variable height, for example to make a tab which is continuous, or convex, and optionally even interrupted as shown in FIGS. 14 to 18.

Even the thickness of the projection 31 in the tab 32 can be angularly variable just as the thickness can be variable with the height to create a projection whose end edge 31''' is tapered, or optionally bevelled.

Thanks to the cap 101, which has the projection 31 positioned in the tab 32, the capacity for locking the closure element 6 in the open position can be further increased.

The presence of the tab 32, and of the projection 31 in the tab 32 allows the projection 31 to be positioned even further towards the free edge 16, the bottom edge 32*a* protruding relative to the connecting bands 29, 30, and therefore allows greater freedom in the locking of the closure element 6 relative to the neck 18.

In use, the cap 101 is positioned in the open position as previously described and the first connecting band 29 remains joined to the retaining ring 5 at one end 27 of the peripheral stretch 25' of the incision line 21' and similarly, the second connecting band 30 remains joined to the retaining ring 5 at the further end 28 of the further peripheral stretch 26' of the incision line 21.

During the passage from the closed position to the open position, the connecting bands 29 and 30 are subjected to a twisting movement and the joining portion 8 can overturn upwards moving the bottom edge 32*a* of the tab 32 towards the rim 18*b*. Since the tab 32 protrudes relative to the connecting bands 29, 30 and since the projection 31 is perpendicular to the tab 32, the projection 31 can be positioned resting on the neck 18, whilst the connecting bands 29, 30 deform.

In detail, the end edge 31''' of the projection 31 makes contact with the neck 18 in a position which depends on the position of the projection 31 relative to the separation line 4 and to the incision line 21', and more precisely relative to the central stretch 24' of the incision line 21'.

If, for example, the projection 31 is nearer the bottom edge 32*a* of the tab 32 than the separation line 4, an end edge 31''' of the projection can be positioned resting on the neck 18 in the open position, for example on the upper wall 23*a* of the enlargement 23. In contrast if, for example, the projection 31 is nearer the separation line 4 than the bottom edge 32*a* of the tab 32, then it can be positioned below the enlargement 23, for example to make contact with a lower wall 23*b* of the enlargement 23, or it can make contact with the outer end 23*c* of the enlargement 23, in the open position. In addition, the flexibility of the tab 32 allows improved contact between the projection 31 and the neck 18 since the projection 31 can better adapt to the shape of the neck 18.

This allows an increase in the stability of the locking of the closure element 6 on the neck 18, even in the presence of necks 18 having special dimensions and/or shapes.

The closure element 6 can be stably kept in the open position. Indeed, in order to return the closure element 6 to the closed position, it is necessary to overcome the interference between the joining portion 8 and the neck 18, that is to say, between the projection 31 and the neck 18. Normally, that does not occur accidentally, instead only occurring if the user deliberately applies sufficient force to the closure element 6, that is to say, if the user wishes to move the closure element 6 to the closed position.

Moreover, the fact still applies that the interference which occurs between the projection 31 and the neck 18 makes it difficult for the cap 101 to be able to rotate about the neck 18, due to the rotation of the retaining ring 5 about the neck 18. Indeed, the retaining ring 5 is connected to the joining portion 8 by the connecting bands 29, 30. Consequently, the retaining ring 5 is not free to rotate about the neck 18, instead it can only rotate if the interference between the projection 31 and the neck 18 is overcome.

As already indicated, the side wall 2 can be provided with knurling lines 13. The separation line 4 can intersect the knurling lines 13. In other words, the knurling lines 13 can extend on both sides of, that is to say, both above and below, the separation line 4. However, the separation line 4 can also be made in a portion of the side wall 2 wherein the latter is externally delimited by a substantially smooth outer surface.

That occurs because the separation line 4 is provided in a position as close as possible to the removable fixing means positioned inside the closure element 6, that is to say, to the inner thread. In this way, it is possible to increase the axial dimension of the connecting bands 29, 30.

As already indicated, when the user wishes to reclose the container, the closure element 6 can be returned to the closed position with a sequence of operations in reverse order compared with that previously described. In particular, the user rotates the closure element 6 relative to the neck 18 in order to return it to the closed position. Consequently, the joining portion 8 is also rotated, so as to return the edge 50, or the bottom edge 32*a* of the tab 32, below the connecting bands 29, 30, in a position facing the retaining portion 501. When the end edge 31''' of the projection 31 disengages from the neck 18, the user can perceive a vibration or snap-motion feedback, which can be (but is not necessarily) accompanied by a "click" sound. In this way, the user can be made aware that the closure element 6 is ready to be screwed onto the neck 18 again. Indeed, a disengagement position has been reached, starting from which the closure element 6 can be screwed onto the neck 18 again so as to move it to the closed position.

As already indicated, the thickness of the projection 31 can be appropriately selected depending on the interference with the neck 18 to be obtained.

FIGS. 19 to 23 show a cap which differs from the cap described relative to FIGS. 1 to 6 because it has a projection 31 which is thicker than the projection 31 of the cap of FIG. 1.

For this type of cap all of the previous considerations regarding the cap of FIGS. 1 to 6, as well as all of the variants described for the shape of the projection 31 in FIGS. 14 to 18 apply.

FIG. 21 illustrates the projection 31 configured in such a way that the end edge 31''' can be positioned resting on the neck 18, for example above the enlargement 23 or on the upper wall 23*a* of the enlargement 23, in the open position.

FIG. 22 illustrates a variant of the cap in which the thickness of the projection 31, and/or the position of the projection, is such that the lower wall 31'' of the projection 31 can be positioned below the enlargement 23 in the open position, for example to make contact with the lower wall 23*b* of the enlargement 23.

Figure 23:
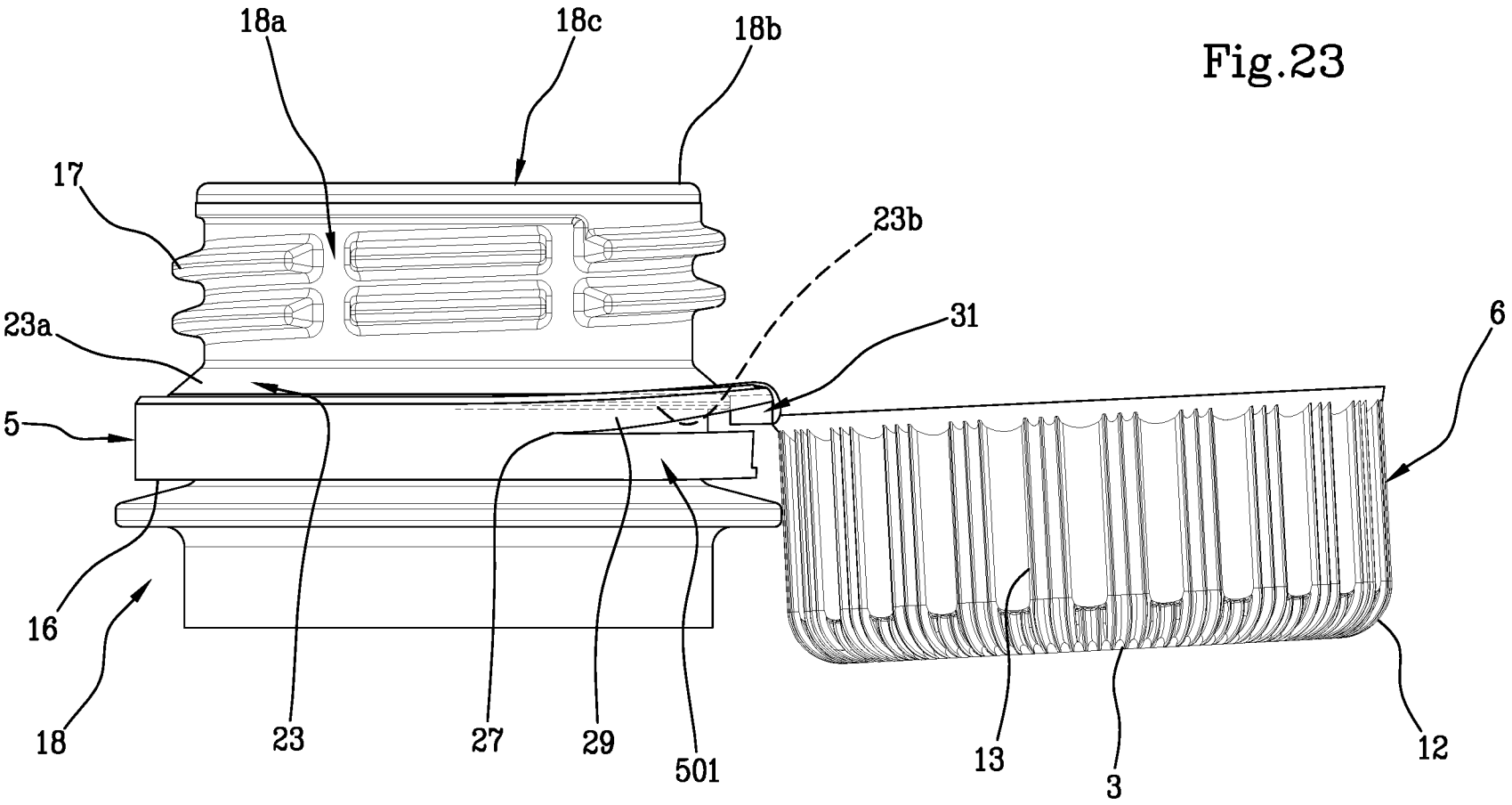
FIG. 23 is a side view of another embodiment of the cap of FIG. 19, in the open position, wherein the projection makes contact with the outer end of the enlargement of the neck.

FIG. 23 illustrates a variant of the cap in which the thickness of the projection 31, and/or the position of the projection, is such that the end edge 31''' of the projection 31 can be positioned substantially parallel to the axis Z and can make contact with the outer end 23*c* of the enlargement 23, in the open position.

Figure 9:
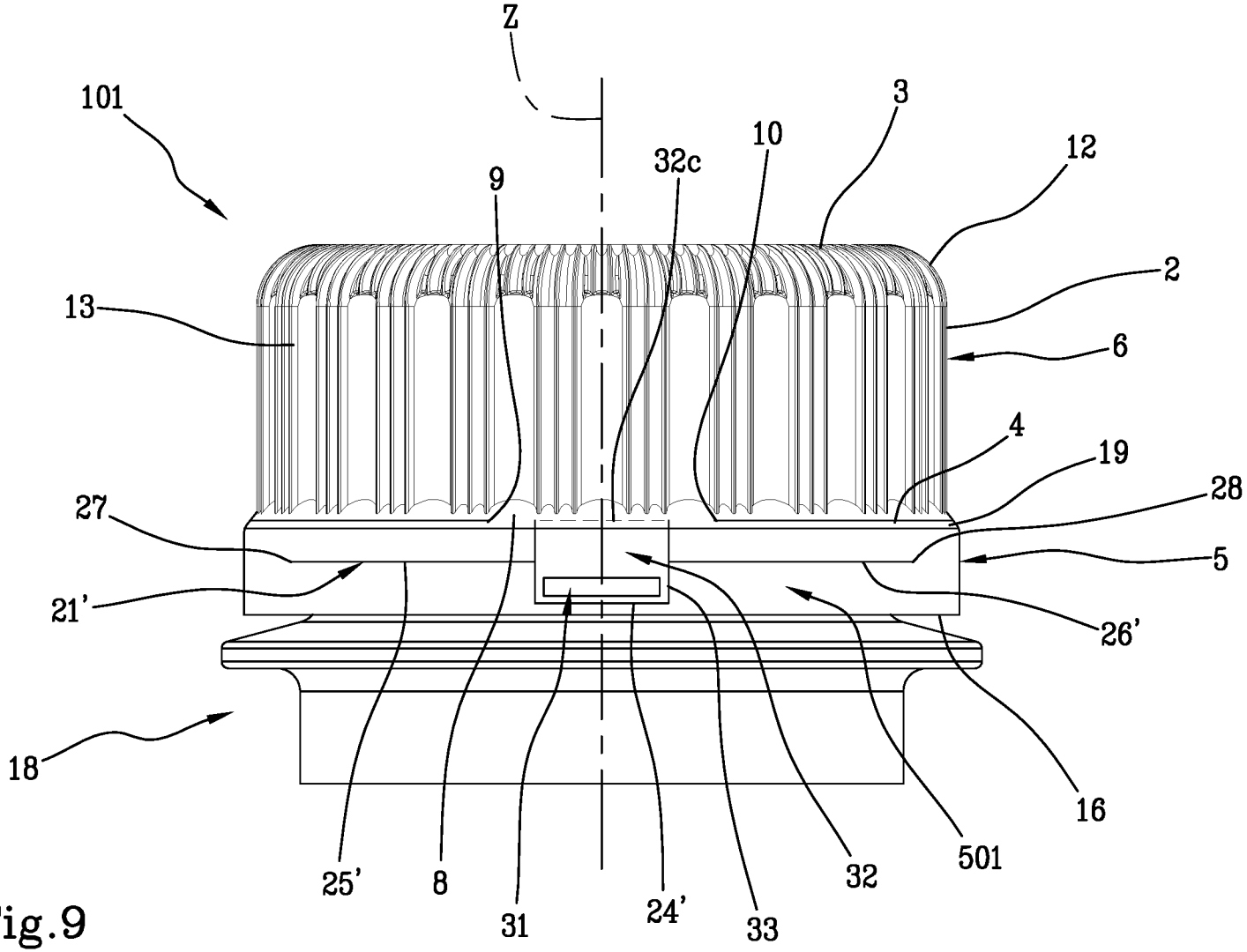
FIG. 9 is a front view of a variant of the cap of FIG. 1, according to an alternative embodiment, in the closed configuration, wherein the projection of the cap is positioned on a tab.

Moreover, FIGS. 24 to 28 show a cap 101 which differs from the cap 101 of FIGS. 9 to 12 because it has a projection 31 which is thicker than the projection 31 of the cap of FIG. 9.

For the cap 101 all of the considerations previously indicated for the cap of FIGS. 9 to 12, as well as the variants described for the shape of the projection 31 in FIGS. 14 to 18 apply. As shown in FIG. 25, the projection 31 is entirely contained in the tab 32 and has a thickness which is approximately equal to half of the axial dimension of the tab 32.

If the projection 31 is on the tab 32, the thickness of the projection 31 selected can be considerable. Indeed the bottom edge 32*a* of the tab 32 can extend beyond the connecting bands 29, 30 as far as near to the free edge 16 of the cap.

Indeed it should be noticed that, as shown in FIG. 26, an end edge 31''' of the projection 31, with increased thickness, it is configured to be positioned resting on the neck 18, making contact both with the upper wall 23*a* of the enlargement 23 and the outer surface 18*a* of the neck 18 above the enlargement 23.

FIG. 27 illustrates a variant of the cap in which the thickness of the projection 31, and/or the position of the projection, is such that the lower wall 31'' of the projection 31 can be positioned below the enlargement 23 in the open position, for example to make contact with the lower wall 23*b* of the enlargement 23.

Figure 28:
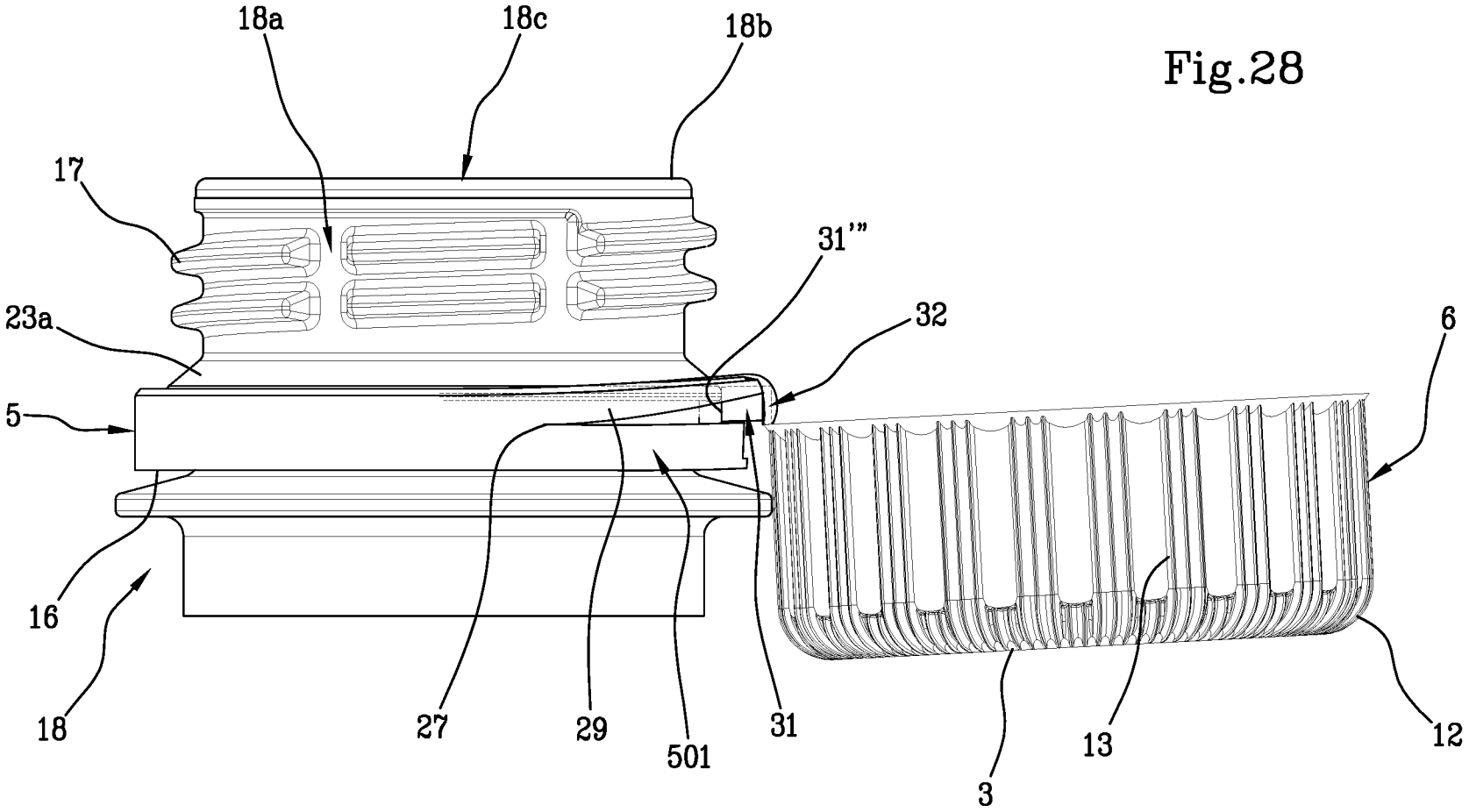
FIG. 28 is a side view of another embodiment of the cap of FIG. 24, in the open position, wherein the projection makes contact with the outer end of the enlargement of the neck.

FIG. 28 illustrates another variant of the cap in which the thickness of the projection 31, and/or the position of the projection, is such that the end edge 31''' of the projection 31 can be positioned substantially parallel to the axis Z and can make contact with the outer end 23*c* of the enlargement 23, in the open position. Thanks to the increased thickness, the upper wall 31' of the projection 31 can be positioned reasting on the retaining portion 501. Both the cap 1 and the cap 101 are particularly easy to make.

The method for making the cap 1, or 101, comprises the following steps:

- making a concave body comprising a side wall 2 extending about an axis Z and a transversal wall 3 arranged at an end of the side wall 2;
- cutting a separation line 4 on the side wall 3 which extends about the axis Z for defining a retaining ring 5 intended to remain anchored to a neck 18 of the container, and a closure element 6 which can removably engage the neck 18, so as to open or close the container; wherein
- the step of cutting the separation line 4 comprises interrupting the cut between a first end 9 and a second end 10, so as to leave the retaining ring 5 and the closure element 6 joined in a joining portion 8. The method for making the cap comprises the further steps of:
- cutting an incision line 21; 21' which extends transversally to the axis Z between the separation line 4 and a free edge 16 of the retaining ring 5, so that two connecting bands 29, 30 are defined between the separation line 4 and the incision line 21; 21', the two connecting bands joining the retaining ring 5 to the joining portion 8;
- on the outside of the joining portion 8 making a projection 31 which projects from the joining portion 8;
- obtaining the separation line 4 and/or the incision line 21, 21' by means of cutting operations using respective blades, for example circular or linear, which are kept still and interact with the side wall 2 when the concave body is rotated; or which are made to rotate whilst the concave body is kept still.

The concave body can be produced by moulding a polymeric material, for example compression moulding or injection moulding.

After the concave body has been formed, the separation line 4 and the incision line 21, or 21' are made on the side wall 2.

The cutting operations to make the separation line 4 and the incision line 21, 21' can be performed for example in a cutting unit positioned downstream of a mould wherein the concave body has been formed. Such cutting operations can be performed using respective blades, for example circular or linear, which interact with the side wall 2 from the outside of the latter, or from the inside. In particular, the concave body can be rotated about the axis Z of the side wall 2, whilst the blades are kept still, so as to move consecutive zones of the side wall 2 to interact, one after another, with the blades. It is also possible to keep still the concave body and to rotate the blades, for making the cut.

The blades which allow the separation line 4 and the incision line 21, 21' to be obtained can be configured to interact with the side wall 2 in respective parallel planes, for example perpendicular to the axis Z, if, as in the desired examples, the separation line 4 and the incision line 21, 21' lie in respective parallel planes.

The blades can have an interrupted cutting edge, if, along the separation line 4 the breakable bridges 7 are to remain defined and/or if, along the incision line 21, 21' respective breakable elements are to remain defined.

It is also possible that the blades do not cut through the entire thickness of the side wall 2, instead only partially cutting through the thickness of the side wall 2, so as to leave, along the incision line 21, 21' and/or along the separation line 4, a thin membrane intended to be broken the first time the cap is opened.

The separation line 4 and the incision line 21, 21' can be made simultaneously, or in two separate steps.

The projection 31 protruding from the concave body can be obtained by means of an undercut part.

The tab 32 can be obtained by making the incision line 21' as previously described, since the central stretch 24' and the peripheral stretches 25' and 26' lie in parallel planes. In contrast, the fracture lines 33 can be made by means of further blades which interact with the side wall 2 from the outside of the latter, or from the inside to cut it along a line parallel to the axis Z. Thus, as for the incision line 21', also along the fracture line 33 breakable elements can be defined or a thin membrane can be left which is intended to break the first time the cap is opened.

Therefore, the cap 1 and the cap 101 are particularly easy to produce, since the concave body can be formed in an ordinary mould with an undercut part. An additional operation, that is to say, making the incision line 21, can be performed very simply while the separation line 4 is obtained.

According to an alternative embodiment, not illustrated, the cap can comprise a tab 32 made by means of an incision line in which the central stretch, when the cap is in the closed position, lies in the same plane as the peripheral stretch and the further peripheral stretch. In this way, the tab has a bottom edge 32*a* which is aligned with the connecting bands 29, 30 and, more specifically, with a free lower edge of the connecting band 29 and with a further free lower edge of the further connecting band 30.

For this type of cap too, the axial dimension of the tab is determined by the length of the cuts 33 which extend from opposite ends of the central stretch. The cap 1, previously described is made of plastic material, for example polypropylene (PP) or polyethylene (PE).

If PE is used, its density can range from low density to high density. In particular, it is possible to use high density polyethylene (HDPE).

The high density polyethylene (HDPE) used to make the cap previously described can have the following properties:

density variable between 950 and 968 kg/m3;

melt index variable from 0.3 to 20 g, in the following measuring conditions: 10 minutes 190° C., 2.16 kg;

molecular weight distribution wide, or narrow, or unimodal, or multimodal.

If PP is used, that material can be in the form of a homopolymer, or heterophasic copolymer, or even statistical copolymer.

The melt index of the PP can vary from 2 to 20 g, in the following measuring conditions: 10 minutes, 230° C., 2.16 kg.host of the central cut.

The invention claimed is:

1. A cap for a container, comprising a side wall (2) extending about an axis (Z) and a transversal wall (3) arranged at an end of the side wall (2), a separation line (4) being provided on the side wall (2) for defining:

a retaining ring (5) intended to remain anchored to a neck (18) of the container, which is configured to internally engage with an enlargement (23) of the neck (18);

a closure element (6) which can removably engage the neck (18), so as to open or close the container; wherein the separation line (4) extends about the axis (Z) and is circumferentially interrupted so as to leave a joining portion (8), between the retaining ring (5) and the closure element (6), which extends circumferentially for a respective angle, the cap (1; 101) also having an incision line (21; 21') which extends transversally to the axis (Z) between the separation line (4) and a free edge (16) of the retaining ring (5), so that two connecting bands (29, 30) are defined between the separation line (4) and the incision line (21; 21'), the two connecting bands joining the retaining ring (5) to the joining portion (8); wherein the connecting bands (29, 30) are deformable, for allowing the joining portion (8) to rotate when the closure element (6) is moved from a closed position to an open position, and wherein the joining portion (8) is externally provided with a projection (31) which projects from the joining portion (8) and is positioned between a separation plane in which the separation line (4) lies, and the incision line (21; 21') so that, when the closure element (6) is in the open position and the connecting bands (29, 30) keep the closure element (6) connected to the retaining ring (5), an edge (50) of the joining portion (8) which, in the closed position, faces the retaining ring (5), is facing, in the open position, towards a rim (18*b*) of the neck (18) and the projection (31) is resting on the neck (18) in said open position; and wherein the incision line (21) comprises a central stretch (24) which is interposed between a peripheral stretch (25) and a further peripheral stretch (26), wherein the peripheral stretch (25) and the further peripheral stretch (26) are aligned with each other, transversal to the axis Z and they extend in a first plane parallel to the separation plane, when the cap is in the closed position, in which the central stretch (24) also lies, the projection (31) being positioned between the central stretch (24) and the separation plane.

2. The cap according to claim 1, wherein the projection (31) extends about the axis (Z) for a respective angle of greater than, or equal to, 4°, to less than, or equal to, 90°.

3. The cap according to claim 1, wherein the projection (31) has a thickness greater than, or equal to, 0.4 mm, and less than, or equal to 4.0 mm.

4. The cap according to claim 3, wherein the thickness is measured along a line parallel to the axis (Z), in the closed position of the closure element (6), and is constant along an entire angle of extension of the projection (31) about the axis (Z).

5. The cap according to claim 1, wherein the projection (31) is positioned nearer the incision line (21; 21') than the separation line (4) so that an end edge (31''') of the projection (31) can be positioned resting on the neck (18) in the open position or on an upper wall (23*a*) of the enlargement (23).

6. The cap according to claim 1, wherein the projection (31) is positioned nearer the separation line (4) than the incision line (21; 21'), so that a lower wall (31'') of the projection (31) which in the closed position is facing towards the free edge (16), can be positioned below the enlargement (18) to make contact with a lower wall (23*b*) of the enlargement (23).

7. The cap according to claim 5, wherein the projection (31) has a plane of symmetry positioned transversally when the closure element (6) is in the closed position, between the projection (31) and the separation line (4), and between the projection (31) and the incision line (21; 21') there being respectively a first distance and a second distance which are respectively the distances between the plane of symmetry and the separation plane and between the plane of symmetry of the projection (31) and a plane in which the incision line (21; 21') lies, the projection (31) being nearer the separation line (4) if the second distance is greater than the first distance, the projection (31) being nearer the incision line (21; 21') if the first distance is greater than the second distance.

8. The cap according to claim 1, wherein the cap comprises two cuts which extend from opposite ends of the central stretch (24) towards the transversal wall (3) and comprises a tab, whose bottom edge is made by means of the central stretch (24) whose side edges are made by means of the cuts to make a tab whose bottom edge is aligned with the connecting bands (29, 30); the projection (31) being at least partially contained in the tab (32).

9. The cap according to claim 8, wherein the projection (31) is positioned nearer the bottom edge (32*a*) of the tab (32) than the separation line (4) so that an end edge (31''') of the projection (31) can be positioned resting on the neck (18) in the open position, for example above the enlargement (23), or on an upper wall (23*a*) of the enlargement (23).

10. The cap according to claim 8, wherein the projection (31) is positioned nearer the separation line (4) than the bottom edge (32*a*) of the tab (32), so that a lower wall (31'') of the projection (31) which in the closed position is facing towards the free edge (16), can be positioned below the enlargement (18), for example to make contact with a lower wall (23*b*) of the enlargement (23).

11. The cap according to claim 1, wherein the projection (31) projects from the side wall (2) for a height measured along a line transversal to the axis (Z) in the closed position of the closure element (6), which is constant along an entire angle of extension of the projection (31) about the axis (Z).

12. The cap according to claim 1, wherein the projection (31) projects from the side wall (2) for a height measured along a line transversal, in particular perpendicular, to the axis (Z) in the closed position of the closure element (6), which is variable along an entire angle of extension of the projection (31) about the axis (Z) to define a projection (31) having an end edge (31''') with a shape that is concave, or convex, or interrupted, or planar.

13. The cap according to claim 12, wherein the projection (31) comprises a plurality of portions which are positioned about the axis (Z), wherein some portions (34') have a predetermined height, which may vary about the axis (Z), and other portions (34'') have a height equal to 0 and are positioned between two portions (34') having predetermined height, in such a way that the projection (31) has an end edge (31''') which is interrupted, but which as a whole has the desired shape.

14. The cap according to claim 1, wherein the projection (31) projects from the side wall (2) for a height measured along a line transversal, in particular perpendicular, to the axis (Z) in the closed position of the closure element (6), which is less than, or equal to 4.0 mm.

15. The cap according to claim 1, wherein the respective angle of extension of the joining portion (8) is greater than, or equal to, 20° to less than, or equal to, 120°.

16. The cap according to claim 1, the cap made by a method comprising the following steps:

making a concave body comprising a side wall (2) extending about an axis (Z) and a transversal wall (3) arranged at an end of the side wall (2);

cutting a separation line (4) on the side wall (3) which extends about the axis (Z) for defining a retaining ring (5) intended to remain anchored to a neck (18) of the container, and a closure element (6) which can removably engage the neck (18), so as to open or close the container; wherein the step of cutting the separation line (4) comprises interrupting the cut between a first end (9) and a second end (10), so as to leave the retaining ring (5) and the closure element (6) joined in a joining portion (8); and wherein the method for making the cap comprises the further steps of:

cutting an incision line (21; 21') which extends transversally to the axis (Z) between the separation line (4) and a free edge (16) of the retaining ring (5), so that two connecting bands (29, 30) are defined between the separation line (4) and the incision line (21; 21'), the two connecting bands joining the retaining ring (5) to the joining portion (8);

on the outside of the joining portion (8) making a projection (31) which projects from the joining portion (8);

obtaining the separation line (4) and/or the incision line (21, 21') by means of cutting operations using respective blades, which are kept still and interact with the side wall (2) when the concave body is rotated; or which are made to rotate whilst the concave body is kept still.

* * * * *